US010633138B2

(12) United States Patent
Hasegawa et al.

(10) Patent No.: US 10,633,138 B2
(45) Date of Patent: Apr. 28, 2020

(54) PRINTING APPARATUS, PRINTING METHOD AND COMPUTER-READABLE MEDIUM

(71) Applicant: CASIO COMPUTER CO., LTD., Shibuya-ku, Tokyo (JP)

(72) Inventors: Hirokazu Hasegawa, Koganei (JP); Toshiaki Kanamura, Ome (JP); Yoshimasa Yokoyama, Hachioji (JP); Yasushi Murai, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 158 days.

(21) Appl. No.: 15/902,987

(22) Filed: Feb. 22, 2018

(65) Prior Publication Data

US 2018/0273230 A1 Sep. 27, 2018

(30) Foreign Application Priority Data

Mar. 27, 2017 (JP) ..... 2017-061304

(51) Int. Cl.

| | |
|---|---|
| ***B41J 11/66*** | (2006.01) |
| ***B65C 9/18*** | (2006.01) |
| ***B26D 5/20*** | (2006.01) |
| ***B65C 11/02*** | (2006.01) |
| ***B41J 3/407*** | (2006.01) |

(52) U.S. Cl.

CPC ..... *B65C 9/1803* (2013.01); *B26D 5/20* (2013.01); *B41J 3/4075* (2013.01); *B41J 11/663* (2013.01); *B65C 11/0215* (2013.01); *B65C 2009/1834* (2013.01)

(58) Field of Classification Search

CPC ..... B26D 5/20; B41J 11/66–70; B41J 11/663; B41J 29/00; B65C 9/00; B65C 9/08; B65C 9/18; B65C 9/1803

See application file for complete search history.

(56) References Cited

U.S. PATENT DOCUMENTS 5,163,349 A * 11/1992 Takagi ..... B26D 3/085 156/510
5,409,317 A * 4/1995 Ueno ..... B41J 3/4075 400/279

(Continued)

FOREIGN PATENT DOCUMENTS

| | | | |
|---|---|---|---|
| CN | 1131603 | A | 9/1996 |
| CN | 1202425 | A | 12/1998 |
| JP | 2011194574 | A | 10/2011 |

OTHER PUBLICATIONS

Chinese Office Action dated Sep. 2, 2019 (and English translation thereof) issued in Chinese Application No. 201810244849.1.

*Primary Examiner* — Nguyen Q. Ha
(74) *Attorney, Agent, or Firm* — Holtz, Holtz & Volek PC

(57) ABSTRACT

A printing apparatus includes a print head, a first cutter and a processor. The print head performs printing on a printing medium. The first cutter cuts the printing medium on which the print head has performed the printing. The first cutter trims away a corner at an end in a width direction of the printing medium. The processor controls the print head and the first cutter based on cutting information on an area to be trimmed by the first cutter so that a printing area of the printing medium is not cut by the first cutter.

8 Claims, 13 Drawing Sheets

(56) References Cited

U.S. PATENT DOCUMENTS

| | | | | |
|---|---|---|---|---|
| 6,116,129 | A | 9/2000 | Takayama et al. | |
| 6,146,035 | A | 11/2000 | Ishigouoka et al. | |
| 6,190,066 | B1 | 2/2001 | Ishigouoka et al. | |
| 6,676,314 | B2 * | 1/2004 | Tanaka | B41J 3/4075 400/61 |
| 2014/0037359 | A1 * | 2/2014 | Nakajima | B41J 11/663 400/621 |
| 2015/0156342 | A1 * | 6/2015 | Fries | H04N 1/00411 358/1.15 |
| 2018/0001676 | A1 * | 1/2018 | Kamei | B26D 1/085 |
| 2018/0240369 | A1 * | 8/2018 | Mallya | B65C 9/22 |
| 2018/0367684 | A1 * | 12/2018 | Tsuji | B41J 11/663 |

* cited by examiner

PRINTING APPARATUS, PRINTING METHOD AND COMPUTER-READABLE MEDIUM

CROSS-REFERENCE TO RELATED APPLICATIONS

This application is based upon and claims the benefit of priority under 35 USC 119 of Japanese Patent Application No. 2017-061304 filed on Mar. 27, 2017 the entire disclosure of which, including the description, claims, drawings, and abstract, is incorporated herein by reference in its entirety.

BACKGROUND OF THE INVENTION

1. Field of the Invention

The present invention relates to a printing apparatus, a printing method and a computer-readable medium.

2. Description of Related Art

Some printing apparatuses (label printers) known in the art are intended for making labels as printed matters by printing an arbitral text, figure, picture or the like on a long strip of a printing medium and cutting out the printed part of the printing medium.

A type of such label printers includes a half-cutting mechanism for cutting only a base of a printing medium that is composed of the base with an adhesive side and a release paper covering the adhesive side and a full-cutting mechanism for cutting both the base and the release paper to separate a printed part from the remaining part of the printing medium. It is expected that labels made by such label printers are used by peeling bases off from release papers and pasting them on desired objects.

A possible technique to make a label less peelable from an object is trimming the label by cutting off the right-angled corners at the ends in the width direction of the rectangular label before pasting it on the object.

In this regard, for example, a patent document (JP 2011-194574A) proposes a trimming apparatus for cutting off the corners at the ends in the width direction of a label. The trimming apparatus is attachable to a label printer and configured such that when the user prints a label with the label printer and then places the printed label in the trimming apparatus, it cuts off the corners at the ends in the width direction of a label without a burden on a user.

However, it is troublesome for the user to place a printed label in the trimming apparatus. Further, since printing and trimming cannot be performed as a single process, it is difficult to make less-peelable labels with trimmed corners rapidly and continuously.

Furthermore, since a printing process and a trimming process are not coordinated with each other as a single process, the quality of the label may sometimes be poor. For example, misalignment of the print area and the trimming position may occur.

SUMMARY

The present invention has been made in view of the above-described circumstances and is advantageous in that it can coordinate a printing process with a trimming process and thereby enables rapid and continuous production of less-peelable printed matters with trimmed corners.

To achieve at least one of the abovementioned objects, according to an aspect of the present invention, a printing apparatus includes:

a printer which performs printing on a printing medium;

a first cutter which cuts the printing medium on which the printer has performed the printing; and a processor;

wherein the first cutter trims away a corner at an end in a width direction of the printing medium; and wherein the processor controls the printer and the first cutter based on cutting information on an area to be trimmed by the first cutter so that a printing area of the printing medium on which the printer has performed the printing is not trimmed by the first cutter.

According to another aspect of the present invention, there is provided a printing method for a printing apparatus, wherein the printing apparatus includes:

a printer which performs printing on a printing medium; and a first cutter which cuts the printing medium on which the printer has performed the printing, so as to trim a corner at an end in the width direction of the printing medium, and wherein the method includes:

obtaining cutting information on an area to be trimmed by the first cutter; and making an adjustment based on the cutting information so that a printing area of the printing medium on which the printer has performed the printing is not trimmed by the first cutter.

According to still another aspect of the present invention, there is provided a stores a program for a computer in a printing apparatus that includes a printer which performs printing on a printing medium and a first cutter which cuts the printing medium on which the printer has performed the printing, wherein the program causes the computer to execute control of the printer and the first cutter based on cutting information on an area to be trimmed by the first cutter so that a printing area of the printing medium on which the printer has performed the printing is not trimmed by the first cutter.

BRIEF DESCRIPTION OF THE SEVERAL VIEWS OF THE DRAWING

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

An embodiment of the printing apparatus and the printing method of the present invention will be described referring to FIG. 1 to FIG. 20.

While the following embodiment has a variety of limitations that are preferred for embodying the present invention, it is not intended to limit the scope of the present invention to the following embodiment and illustrated examples.

Figure 1:
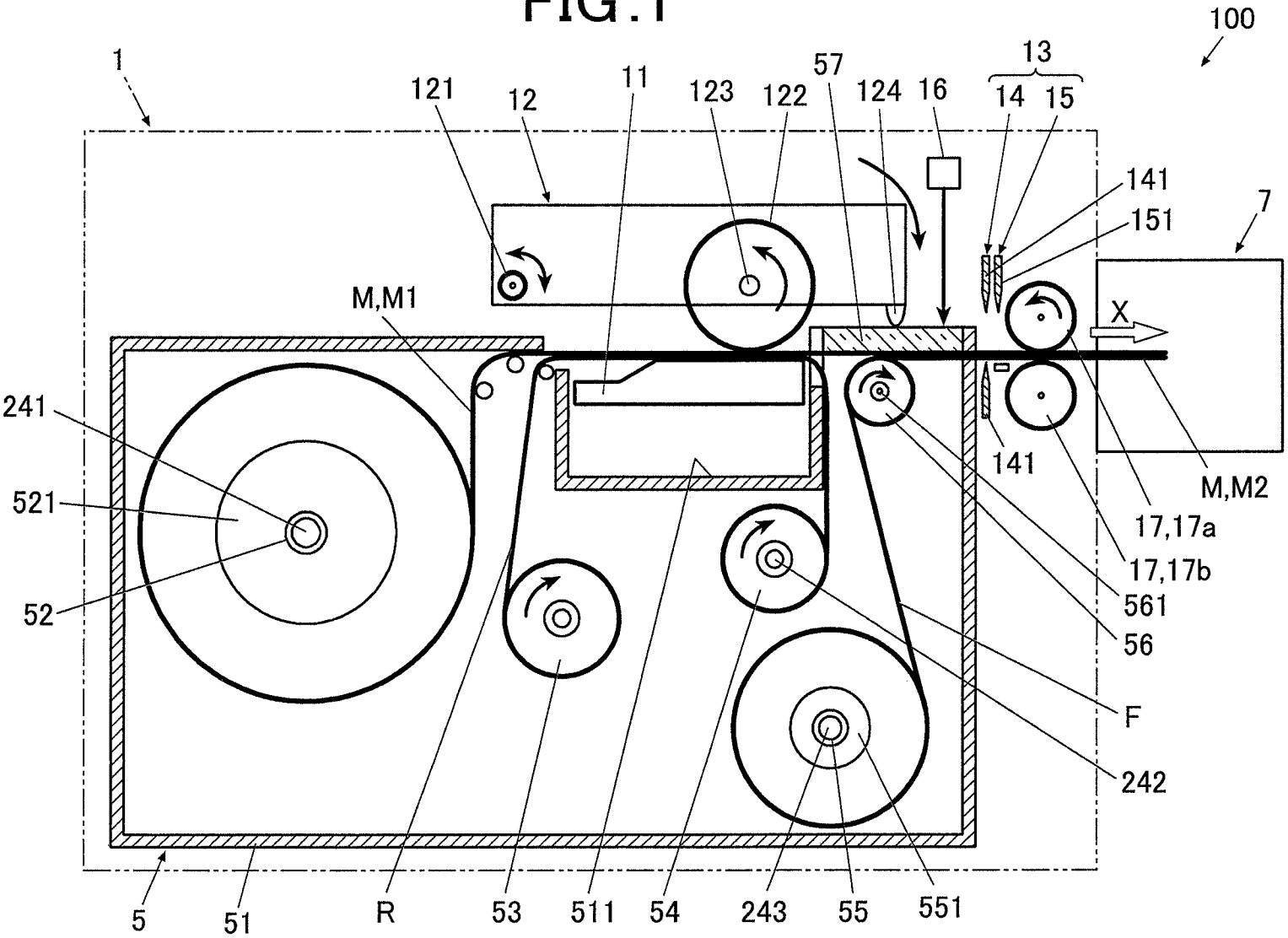
FIG. 1 is a schematic view of a printing apparatus according to an embodiment.

FIG. 1 is a schematic view of the printing apparatus according to the embodiment, illustrating the schematic configuration thereof.

As illustrated in FIG. 1, the printing apparatus 100 of the embodiment includes a main body 1, and a cutting unit 7 with a trimming cutter mechanism 75 as a first cutter (described later).

The main body 1 as illustrated in FIG. 1 includes a thermal head 11, which is an example of a print head that performs printing on a long strip of a printing medium M. For example, the main body 1 is constituted by a label printer that performs single-pass printing. For example, the printing medium M is a tape material that includes a base Ma with an adhesive side and a peelable release paper Mb covering the adhesive side.

In the embodiment, the thermal head 11 as the printer performs printing on the other side of the base Ma from the adhesive side (referred to as the front side of the base Ma) as described later. The following description is based on an example in which the main body 1 is constituted by a thermal transfer label printer using an ink ribbon. However, the printing method is not particularly limited and may be, for example, a thermal method using a thermal paper.

In the embodiment, a laminate film F is pasted on the front side of the base Ma after the printer (thermal head 11 in the embodiment) performs printing, which will be described later.

In the following description, the printing medium M before printing is referred to as a printing medium M1, and the printing medium M after printing on which the laminate film F is pasted is referred to as a printing medium M2 (printed matter). When it is not concerned whether or not processing such as printing and pasting of the laminate film F has been performed, the printing medium is simply referred to as a printing medium M (printer tape).

In the embodiment, labels on which a text or the like is printed are given as an example of the printing medium M2 (printed matter). In this regard, each printed matter cut from the long printing medium M is referred to as a label L (see FIG. 8).

Configuration of Main Body

Figure 2:
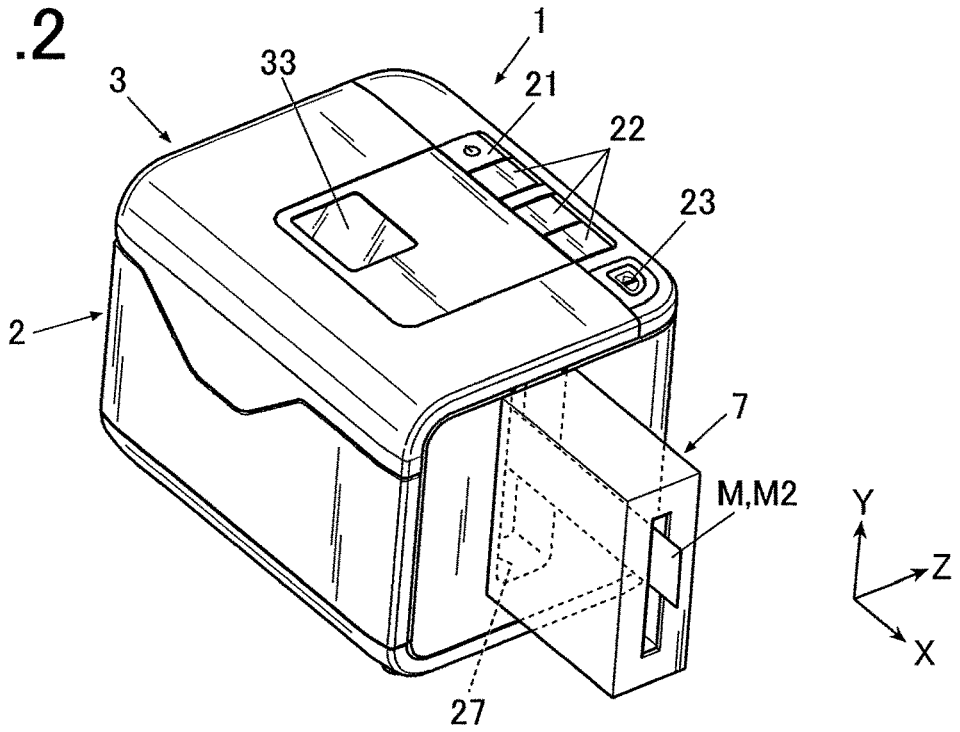
FIG. 2 is a perspective view of a main body of the printing apparatus according to the embodiment.
Figure 3:
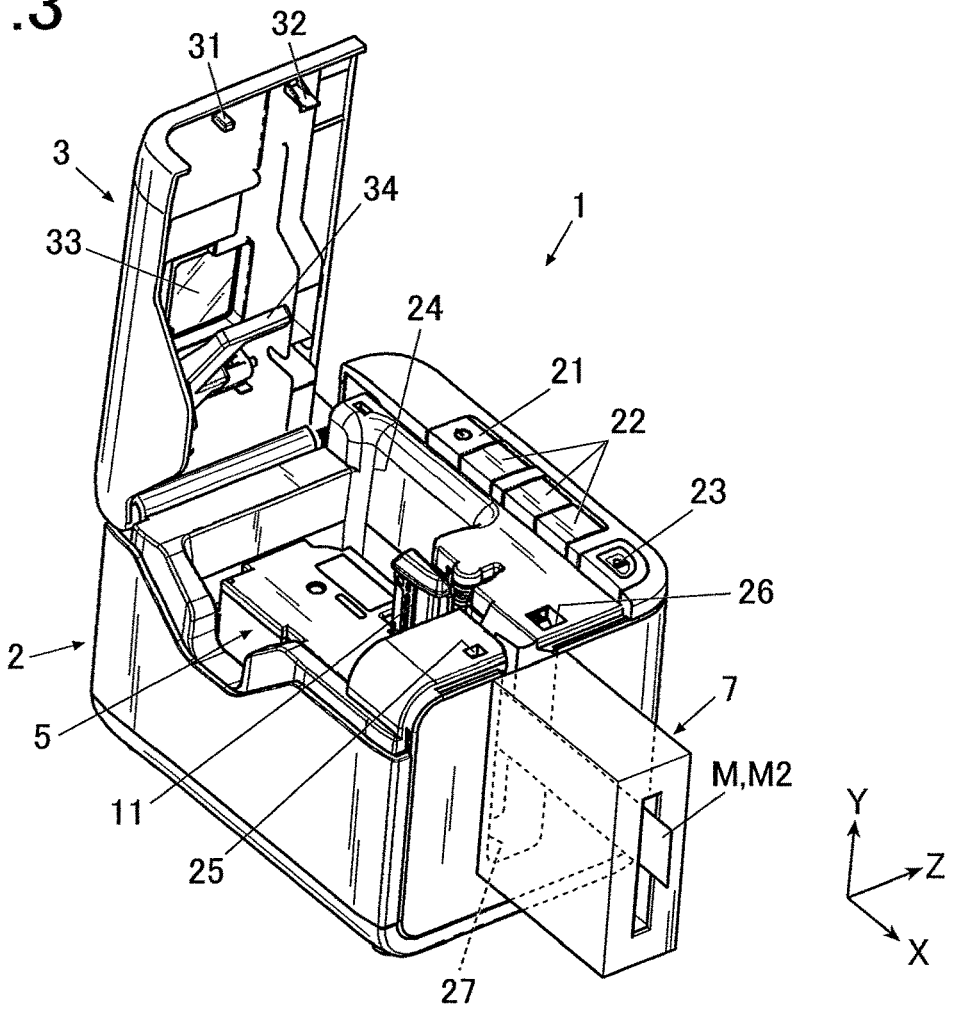
FIG. 3 is a perspective view of the main body according to the embodiment, illustrating the state in which the openable cover is open.

FIG. 2 is a perspective view of the main body of the printing apparatus according to the embodiment, and FIG. 3 is a perspective view of the main body in the state in which an openable cover is open.

As used herein, the term "conveyance X direction" refers to the direction in which the printing medium M (printer tape) is conveyed, the term "medium width Y direction" refers to the width direction of the printing medium M (printer tape) perpendicular to the conveyance X direction and the term "thickness Z direction" refers to the thickness direction of the printing medium M (printer tape). The X direction, the Y direction and the Z direction are orthogonal to each other.

As illustrated in FIG. 2, the main body 1 includes a case 2 and the openable cover 3 attached to the case 2 in an openable/closable manner. As illustrated in FIG. 3, the case 2 includes a cassette housing 24 in which a tape cassette 5 (described later) is housed.

On the top face of the case 2, a power button 21, operation buttons 22 for a variety of operations, a cover operation button 23 for releasing the openable cover 3 and the like are disposed.

In the condition in which the external power supply D (see FIG. 10) is connected (i.e. an AC adapter is connected), when the power button 21 is pushed, a signal is sent to a power supply circuit 107 (see FIG. 10) so that the printing apparatus 100 (i.e. the main body 1 and the cutting unit 7 electrically connected thereto) are turned on.

When the operation buttons 22 or the cover operation button 23 is pushed, a corresponding signal is sent to an operation input control circuit 106 (see FIG. 10) so that a corresponding processing is performed.

The cover operation button 23 of the embodiment is provided only to release the openable cover 3. To close the openable cover 3, the user manually closes the openable cover 3.

Although not shown in the figure, the case 2 includes a power cord connector, an external device connector and the like and has a storage medium insertion opening and the like. When the main body 1 is powered by an internal power source such as a battery, the power code connector is not necessary. Further, when the main body 1 is configured to be connectable with various terminals and personal computers including an external computer 200 (see FIG. 10, described below) through wireless communication, the external device connector is not necessary.

The openable cover 3 is disposed to cover the upper part of the cassette housing 24 in an openable and closable manner. The openable cover 3 opens when the cover operation button 23 is pushed.

In the embodiment, the openable cover 3 includes a protrusion 31 that protrudes from the inner side (i.e. the side facing the cassette housing 24) toward the inside of the case 2, and a cover open/close sensor 25 for detecting the protrusion 31 is disposed at a position corresponding to the protrusion 31 when the openable cover 3 is closed. When the cover open/close sensor 25 detects the user closing the openable cover 3, the detection result is output to a sensor input circuit 113 (see FIG. 10) of the processor 10 (described later).

The openable cover 3 includes a locking hook 32 that protrudes from the inner side (i.e. the side facing the cassette housing 24) toward the inside of the case 2, and a locking recess 26 that engages with the locking hook 32 is formed at a position corresponding to the locking hook 32 when the openable cover 3 is closed. When the openable cover 3 is closed, the locking hook 32 is engaged with the locking recess 26 so that the openable cover 3 does not open by mistake. In the condition in which the openable cover 3 is closed, when the cover operation button 23 is pushed, a corresponding signal is output to the operation input control circuit 106 (see FIG. 10), and the engagement of the locking hook 32 is released so that the openable cover 3 opens.

The openable cover 3 has a window 33 so that the user can visually check whether the tape cassette 5 (see FIG. 3 to FIG. 5) is loaded in the cassette housing 24 even when the openable cover 3 is closed.

The openable cover 3 includes a cassette presser 34 that is disposed on the inner side (i.e. the side facing the cassette housing 24) to press the tape cassette 5 loaded in the cassette housing 24. The cassette presser 34 presses the tape cassette 5 from above so as to prevent the tape cassette 5 from being displaced or lifted when the openable cover 3 is in a closed position. The thickness of the tape cassette 5 differs depending on the width of the housed printing medium M1 (printer tape), and the height of the top face thereof differs accordingly when it is loaded in the cassette housing 24. To address this, it is preferred that the cassette presser 34 is elastic so as to be compatible with different heights.

In the cassette housing 24, a tape type detection sensor 18 is disposed to detect the type of the tape cassette 5 loaded therein (the type of the printing medium M (printer tape) housed in the tape cassette 5).

For example, the tape type detection sensor 18 detects the tape type such as the width of the printing medium M (printer tape) housed in the tape cassette 5, for example, by reading an identification mark or the like on a cassette case 51 (see FIG. 4 and FIG. 5) of the tape cassette 5.

The detection result detected by the tape type detection sensor 18 is output to the sensor input circuit 113 so that the processor 10 of the main body 2 can automatically obtain the type of the tape cassette 5 loaded in the main body 2. The tape type detection sensor 18 may be constituted by any component that can identify the type of the tape cassette 5, and the specific arrangement, configuration and the like are not particularly limited.

In the cassette housing 24, driving shafts 241, 242, 243 are disposed at a position corresponding respectively to the center axes of a printer tape roller 52, an ink ribbon winding roller 54 and a laminate film roller 55 of the tape cassette 5 (described later).

That is, when the tape cassette 5 is in the cassette housing 24, the driving shaft 241 is engaged with the printer tape roller 52, the driving shaft 242 is engaged with the ink ribbon winding roller 54, the driving shaft 243 is engaged with the laminate film roller 55.

The driving shafts 241, 242, 243 are connected to a stepping motor 118 that is controlled by a conveyer motor control circuit 108 (described below), so that they are rotary driven according to the control of the conveyer motor control circuit 108. The printer tape roller 52, the ink ribbon winding roller 54 and the laminate film roller 55 that are engaged with the driving shafts 241, 242, 243 are rotated accordingly.

In the cassette housing 24, the thermal head 11 as the printer of the embodiment is disposed.

The thermal head 11 is disposed in the conveyance path of the printing medium M that is conveyed by a platen roller 122 and the like of a conveyer. The thermal head serves as a printer that performs printing on the printing medium M.

For example, the thermal head 11 includes heating elements that are arrayed in a main scanning direction (the medium width Y direction perpendicular to the conveyance X direction of the printing medium M1 (printer tape)). The thermal head 11 performs printing on the printing medium M line by line by thermal transfer, in which the heating elements are selectively turned on according to print data by the control of a head driver circuit 112 (see FIG. 10, described later).

A platen unit 12 is located at a position corresponding to the thermal head 11 across the printing medium M when printing is performed. The platen unit 12 moves up and down in the direction toward and away from the thermal head 11 by means of a platen unit elevating mechanism 125 (see FIG. 10) that moves up and down by means of an elevator motor 116 (see FIG. 10).

The specific configuration of the platen unit elevating mechanism 125 is not particularly limited. For example, as illustrated in FIG. 1, the rotating shaft 121 disposed in the upstream in the conveyance X direction of the printing medium M of the platen unit 12 is driven by the elevator motor 116 (see FIG. 10) so as to rotate the entire platen unit 12 about the rotating shaft 121.

In the embodiment, the operation of the platen unit elevating mechanism 125 is synchronized with opening/closing of the openable cover 3.

That is, when the cover open/close sensor 25 detects the user closing the openable cover 3, the elevator motor control circuit 110 (see FIG. 10) for controlling the elevator motor 116 controls the elevator motor 116 to move the platen unit 12 toward the thermal head 11. Further, when the cover open/close sensor 25 detects the openable cover 3 being opened, the elevator motor control circuit 110 (see FIG. 10) controls the elevator motor 116 to move the platen unit 12 away from the thermal head 11.

In the embodiment, a platen roller 122 is opposed to the thermal head 11 inside the platen unit 12 when printing is performed. The platen roller 122 of the embodiment is supported by a rotation shaft 123 that extends in the medium width Y direction of the printing medium M inside the platen unit 12. The rotation shaft 123 is rotary driven by the stepping motor 118 that is controlled by the conveyer motor control circuit 108 (see FIG. 10, described below), and the platen roller 122 is rotated in the arrow direction in FIG. 1 according to the rotation of the rotation shaft 123.

When the openable cover 3 is closed and the platen unit 12 moves toward the thermal head 11, the platen roller 14 comes in contact with the thermal head 11 via the printing medium M and conveys the printing medium M in the conveyance X direction while pressing the printing medium M against the thermal head 11 at an approximately even pressure.

In the embodiment, the printing medium M is rewound before printing is started as described later. During the rewinding, the elevator motor 116 is controlled to move the platen unit 12 away from the thermal head 11 regardless of the opening/closing of the openable cover 3 so that the platen roller 122 is not in contact with the thermal head 11 via the printing medium M. This enables smooth rewinding since the platen roller 122 does not resist the printing medium M to be rewound.

In the embodiment, the platen unit 12 includes a projection 124 that is disposed in the downstream in the conveyance X direction of the printing medium M at a position corresponding to a prepress roller 56 that presses the printing medium M against the prepress roller 56.

The shape and the like of the projection 124 are not particularly limited, but it is preferred that the projection 124 has the shape of a rather long plate that extends in the medium width direction Y of the printing medium M or of two or more bosses arranged in the medium width Y direction of the printing medium M so as to be able to press the printing medium M against the prepress roller 56 at as uniform pressure as possible. When the projection 124 is constituted by two or more bosses, it is preferred that they are arranged at approximately regular intervals so that the pressing force is evenly distributed.

A cutter 13 (second cutter of the embodiment) which cuts the printed printing medium M is disposed in the conveyance path of the printing medium in the downstream in the conveyance X direction with respect to the thermal head 11.

The cutter 13 (second cutter) includes a full-cutting mechanism 14 and a half-cutting mechanism 15.

Figure 6:
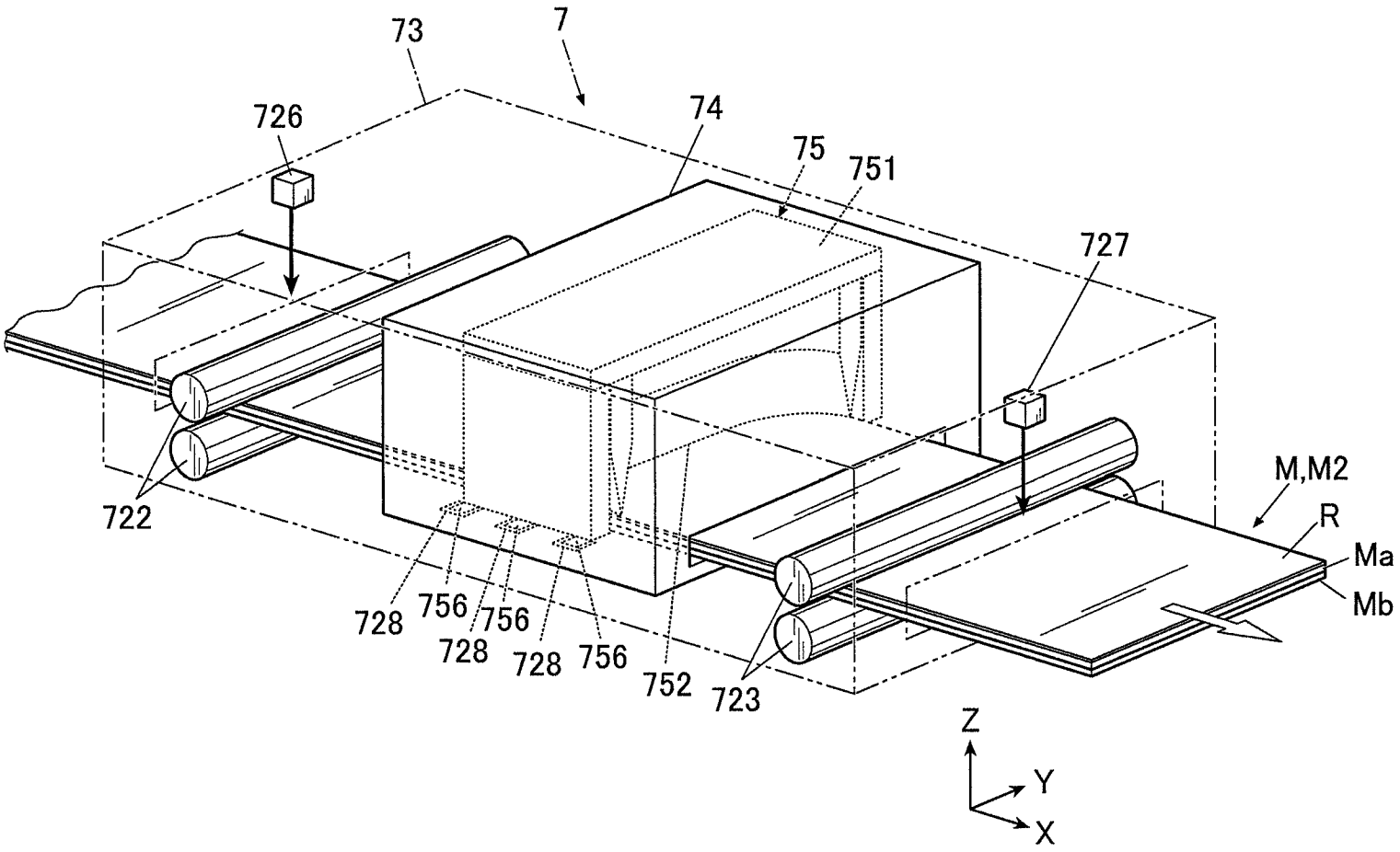
FIG. 6 is schematic perspective view of a cutting unit of the printing apparatus according to the embodiment.

The printing medium M to be cut with the cutter 13 (second cutter) includes the base Ma having a printing face on the front side and an adhesive face on the other side from the printing side and the release paper Mb overlaid on the adhesive face of the base Ma (see FIG. 6). In the embodiment, the laminate film is pasted on the printing side of the base Ma after printing, and the printing medium M2 composed of three layers of the laminate film F, the base Ma and the release paper Mb is conveyed to the cutter 13 (second cutter).

As used herein, full-cutting by the full-cutting mechanism 14 means cutting the laminate film F and the base Ma of the printing medium M along with the release paper Mb in the medium width Y direction, and half-cutting by the half-cutting mechanism 15 means cutting the laminate film F and the base Ma of the printing medium M in the medium width Y direction while leaving the release paper Mb uncut.

The full-cutting mechanism 14 and the half-cutting mechanism 15 of the cutter 13 (second cutter) includes respective cutters 141, 151 that moves down to the respective cutting positions of the printing medium M. That is, the cutters 141 of the full-cutting mechanism 14 moves down to such a position in the thickness Z direction as to cut all three layers of the laminate film F, the base Ma and the release paper Mb. The cutter 151 of the half-cutting mechanism 15 moves down to such a position in the thickness Z direction as to cut only the two layers of the laminate film M and the base Ma but not to cut the release paper Mb.

The cutters 141, 151 of the full-cutting mechanism 14 and the half-cutting mechanism 15 move in the direction toward and away from the printing medium M by means of a cutter motor 117 (see FIG. 10) that is controlled by a cutter motor control circuit 111 (described later).

The cutting position of the cutters 141, 151 may be defined by the cutter motor control circuit 111 that controls the cutter motor 117. In the half-cutting mechanism 15, a stopper (not shown) may be provided to stop the cutter 151 in such a position in the thickness Z direction as to allow it to cut only the two layers of the laminate film F and the base Ma and not to allow it to move down further.

A tape tip detection sensor 16 is disposed in the conveyance path of the printing medium M between the thermal head 11 and the cutter 13 (second cutter) to detect the tip of the printing medium M in the conveyance X direction.

The detection result of the tape tip detection sensor 16 is output to the sensor input circuit 113 of the processor 10.

A pair of main press rollers 17 (upper roller 17*a* and lower roller 17*b*) are disposed in the conveyance path of the printing medium M in the downstream with respect to the cutter 13 (second cutter).

The main press rollers 17 are provided to fix the laminate film F on the surface of the printed base Ma by pressure.

One or both of the upper and lower rollers 17*a*, 17*b* of the main press rollers 17 are connected to a stepping motor 115 that is controlled by an ejector motor control circuit 109. That is, the main press rollers 17 are driving rollers that are rotary driven by the stepping motor 115.

In the embodiment, the upper roller 17*a* is movable in the direction toward and away from the lower roller 17*b*. When the printing medium M is rewound before printing, it moves away from the lower roller 17*b*. This enables a smooth rewinding since the main press rollers 17 do not resist the printing medium M to be rewound.

An ejection opening 27 is formed on a side wall of the case 2 in the downstream in the conveyance X direction of the printing medium M. After the thermal head 11 performs printing on the printing medium M in the main body 1, the main press rollers 17 eject the printing medium M to the outside of the apparatus through the ejection opening 27 while pressing the laminate film F onto the surface of the base Ma to fix it.

In the embodiment, the main body 1 is configured such that the cutting unit 7 is attachable in the vicinity of the ejection opening 27 as illustrated in FIG. 2 and FIG. 3. When the cutting unit 7 is attached on the main body 1, the printing medium M is ejected to the outside of the apparatus through the ejection opening 27 and then conveyed into the cutting unit 7 as illustrated in FIG. 1 to FIG. 3.

Configuration of Tape Cassette

As illustrated in FIG. 3, the tape cassette 5 of the embodiment is detachably loaded in the cassette housing 24 of the main body 1 with the medium width Y direction of the tape cassette 5 being vertical.

Figure 4:
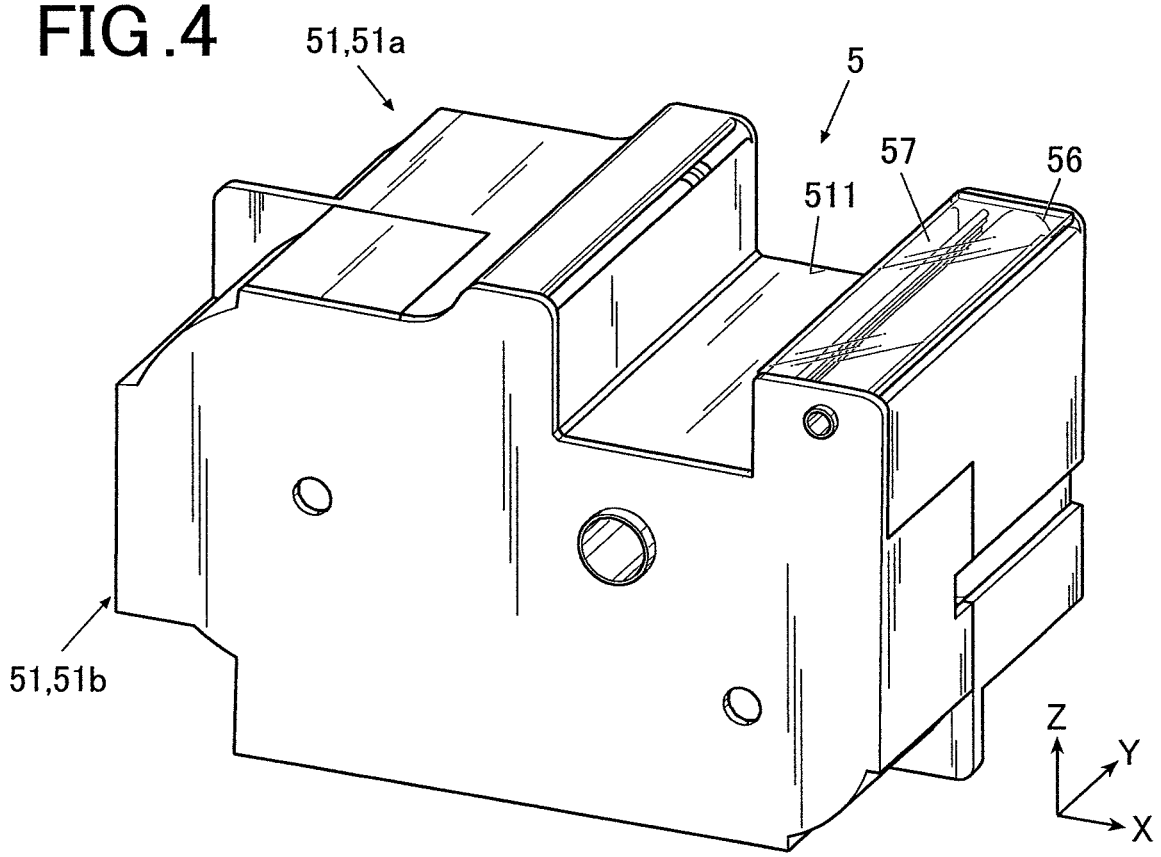
FIG. 4 is a perspective view of a tape cassette to be loaded in the main body according to the embodiment.
Figure 5:
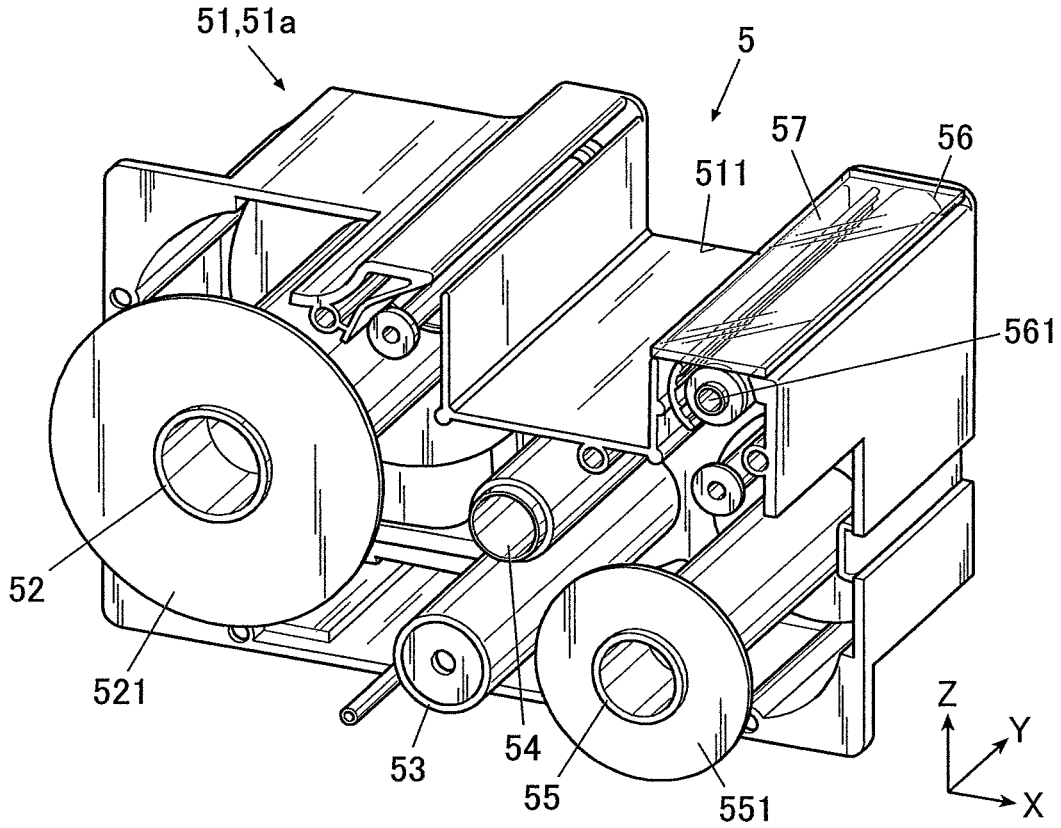
FIG. 5 is a perspective view of the tape cassette according to the embodiment, illustrating the inter structure thereof.

FIG. 4 is a perspective view of the outer appearance of the tape cassette 5 of the embodiment, and FIG. 5 is a perspective view of the tape cassette of FIG. 4 from which a part of the cassette case is removed.

As illustrated in FIG. 4, the tape cassette 5 includes a cassette case 51 in which a thermal head insertion 511 is formed. The cassette case 51 is formed by fitting the lower case 51*a* with the upper case 51*b*.

The thermal head insertion 511 is a recess that is formed at a position corresponding to the thermal head 11 when the tape cassette 5 is loaded in the cassette housing 24 of the main body 1.

FIG. 5 illustrates the inside of the tape cassette 5 from which the upper case 51*b* of the cassette case 51 is removed. In FIG. 5, the printing medium M, the ink ribbon R and the laminate film F are removed from the tape cassette 5.

In the cassette case 51, a printer tape roller 52, an ink ribbon supply roller 53, an ink ribbon winding roller 54 and a laminate film roller 55 are disposed.

The printer tape roller 52 is a driving roller that is engaged with the driving shaft 241 and driven by the stepping motor 118 that is controlled by the conveyer motor control circuit 108.

The printer tape roller 52 includes flanges 521 at the ends in the medium width Y direction and has a bobbin shape as a whole. The printing medium M is wound in a roll shape around the printer tape roller 52.

In the embodiment, the printing medium M is rewound by the control of the conveyer motor control circuit 108 before printing as described later. The flanges 521 at the ends of the printer tape roller 52 reduce misalignment of the rewound printing medium M and thus enables smooth rewinding.

The ink ribbon R for heat transfer is wound in a roll shape around the ink ribbon supply roller 53, and the tip thereof is wound around the ink ribbon winding roller 54.

The ink ribbon winding roller 54, which is engaged with a driving shaft 242, is a driving roller that is driven by the stepping motor 118 controlled by the conveyer motor control circuit 108.

The laminate film roller 55, which is engaged with a driving shaft 243, is a driving roller that is driven by the stepping motor 118 that is controlled by the conveyer motor control circuit 108.

As with the printer tape roller 52, the laminate film roller 55 includes flanges 551 at the ends in the medium width Y direction and has a bobbin shape as a whole. The laminate film F is wound in a roll shape around the laminate film roller 55.

The prepress roller 56 is disposed in the downstream in the conveyance direction of the printing medium M with respect to the laminate film roller 55 at a position corresponding to the projection 124 of the platen unit 12.

The rotation shaft 561 of the prepress roller 56 is connected to the stepping motor 118 that is controlled by the conveyer motor control circuit 108. The prepress roller 56 is a driving roller that is rotary driven according to the control of the conveyer motor control circuit 108.

Between the prepress roller 56 and the projection 124 of the platen unit 12, a transparent plate 57 of a transparent resin or the like is disposed.

When printing, the printing medium M is conveyed between the transparent plate 57 and the prepress roller 56. The transparent plate 57 is biased toward the prepress roller 56 by means of the projection 124 of the platen unit 12, and the base Ma and the laminate film F of the printing medium M are pressed between the transparent plate 57 and the prepress roller 56 and thereby prefixed to each other.

Further, the above-described tape tip detection sensor 16 is disposed at a position corresponding to the transparent plate 57. This allows the tape tip detection sensor 16 to detect the tip of the printing medium M passing under the transparent plate 57 without obstruction by a member of the tape cassette 5 or the like.

In the embodiment, the tape type detection sensor 18 is disposed in the cassette housing 24 of the case 2 to detect the type of the tape cassette 5 (type of the printing medium M (printer tape) loaded in the tape cassette 5) as described above, and an identification mark or the like (not shown) to be detected by the tape type detection sensor 18 is attached on the cassette case 51.

The identification mark or the like may have any configuration that can be read by the tape type detection sensor 18. For example, the identification mark is an uneven pattern formed on the outside of the cassette case 51. In this case, the tape type detection sensor 18 reads the position or the figure of the uneven pattern to detect the type of the tape. The identification mark is not limited to a three-dimensional pattern and may also be a barcode or the like. In this case, the tape type detection sensor 18 is constituted by a barcode reader. The configuration of the identification mark or the like on the tape cassette 5 and the tape type detection sensor to read the mark is not limited to above-described examples.

Configuration of Cutting Unit

As illustrated in FIG. 1, the cutting unit 7 is detachably attached to the main body 1.

In the embodiment, the cutting unit 7 is disposed at a position communicating with the ejection opening 27 that is formed in the downstream in the conveyance X direction of the printing medium M.

The cutting unit 7 includes the trimming cutter mechanism 75 as the first cutter that cuts a printed part of the printing medium M (printed printing medium M2 (printed matter)) in the width direction of the printing medium M to separate it into individual printed matters. The individual printed matters cut out from the printed printing medium M2 (printed matter) are referred to as labels L (see FIG. 8).

Although not shown in the figure, in the embodiment, the cutting unit 7 includes a contact, an electric connector or the like for sending and receiving information to and from the main body 1 of the printing apparatus 100. Similarly, the main body 1 includes a contact, an electric connector or the like at a position corresponding to the contact, the electric connector or the like of the cutting unit 7.

When the cutting unit 7 is attached to the main body 1, the contact, the electric connector or the like of the cutting unit 7 is connected to the contact, the electric connector or the like of the main body 1. As a result, the cutting unit 7 is electrically connected to the main body 1 to share the power and the like with the main body 1. Further, as described later, a cutting unit controller 71 of the cutting unit 7 operates the components of the cutting unit 7 by the control of the processor 10 of the main body 1.

FIG. 6 is a schematic perspective view of the schematic configuration of the cutting unit 7 of the embodiment.

As illustrated in FIG. 6, the cutting unit 7 includes a box case 73. In the case 73, a cutter main body 74 is disposed, which includes the trimming cutter mechanism 75 as the first cutter and a trimming cutter elevating mechanism 725 (see FIG. 10) that moves up and down the trimming cutter mechanism 75.

Figure 7:
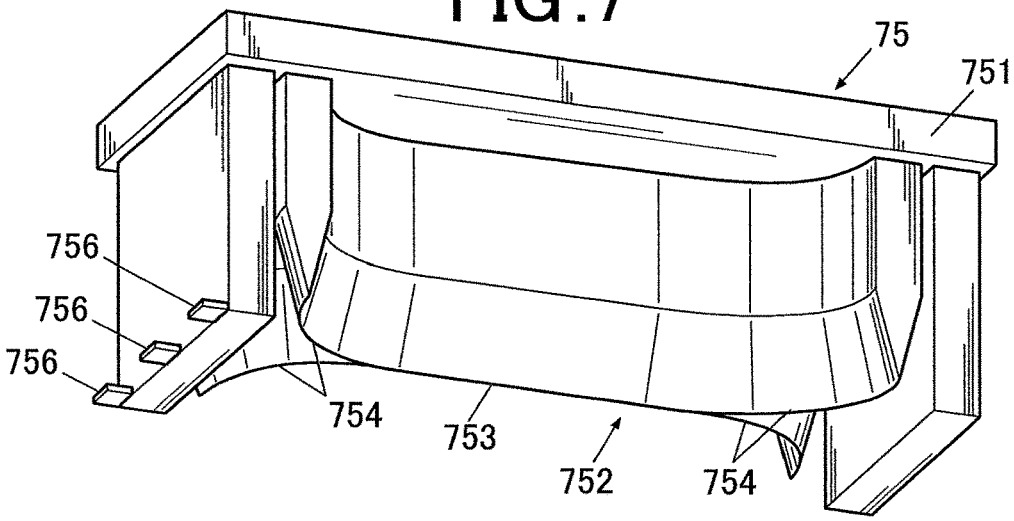
FIG. 7 is a perspective view of a trimming cutter mechanism according to the embodiment.
Figure 8:
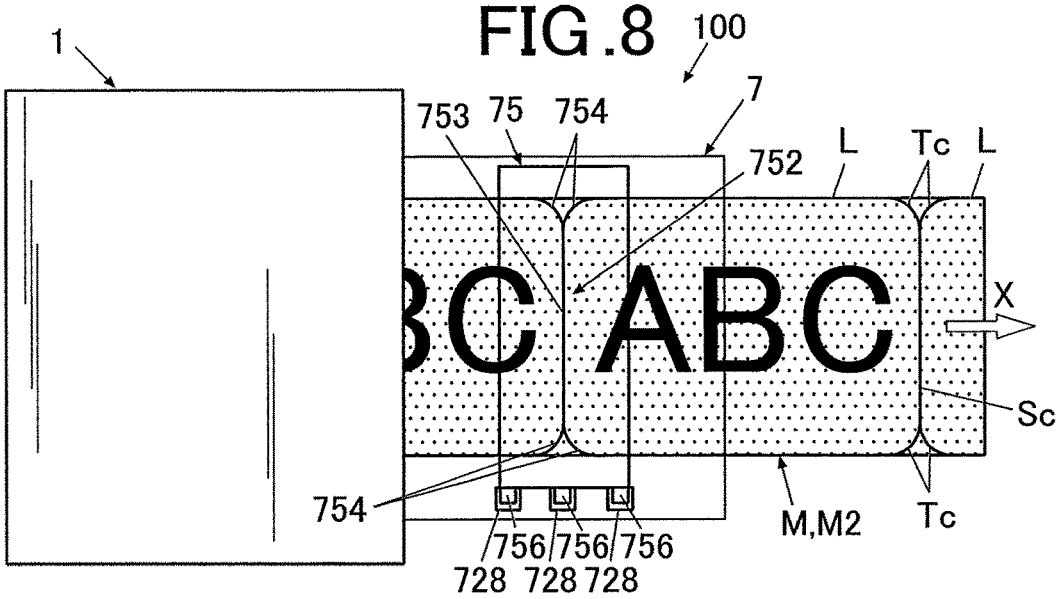
FIG. 8 is a plan view illustrating the process of cutting a printing medium by means of a trimming cutter mechanism.

FIG. 7 is a perspective view of the trimming cutter mechanism 75 of the embodiment, and FIG. 8 is a plan view illustrating the process of cutting the printing medium by means of the trimming cutter mechanism 75.

The trimming cutter mechanism 75 trims the corners at the ends in the width direction of the individual printed matters (labels L), for example, into a round shape by half-cutting the printed printing medium M2 (printed matter) (i.e. cuts only the base Ma and the laminate film F while leaving the release paper Mb uncut).

Specifically, as illustrated in FIG. 6 to FIG. 8, the trimming cutter mechanism 75 includes a straight blade portion (first blade portion) 753 that extends in the width direction of the printing medium M2, and arc blade portions (second blade portions) 754 that are integrally formed at the both ends in the longitudinal direction of the straight blade portion 753 to trim the corners at the ends in the width direction of the individual printed matters (labels L), for example, into an arc shape, a round shape or the like. In the embodiment, the trimming cutter mechanism 75 includes a frame mount 751 and a cutting blade 752 composed of the straight blade portion 753 and the arc blade portions 754 attached on the bottom of the frame mount 751. The configuration of the cutting blade 752 is not limited to the combination of the straight blade portion 753 and the arc blade portions 754. For example, the cutting blade 752 may not include the straight blade portion 753 but be composed of only the arc blade portions 754 that cut the entire width of the printing medium M2, for example, into a curved shape such as arc shape.

The trimming cutter elevating mechanism 725 that moves up and down the trimming cutter mechanism 75 is driven by an elevator motor 724 that is controlled by an elevator motor control circuit 712 (described below). The trimming cutter mechanism 75 moves up and down in the directions toward and away from the printing medium M by means of the trimming cutter elevating mechanism 725.

The mechanism that allows half-cutting of the printing medium M2 (printed matter) with the trimming cutter mechanism 75 is not particularly limited. For example, a stopper (not shown) may be provided at a height approximately corresponding to the thickness of the release paper Mb so as to restrict the cutting blade 752 to move further downward.

When the trimming cutter mechanism 75 moves down to the printing medium M2, the straight blade portion 753 and the arc blade portions 754 form a straight cut portion Sc that extends in the medium width Y direction of the printing medium M2 and arc cut portions (trimmed portions) Tc at both ends in the medium width Y direction of the printing medium M2 of the straight cut portion Sc as illustrated in FIG. 8. The straight cut portion Sc and the arc cut portions Tc are formed simultaneously by a single cutting motion (moving down of the trimming cutter mechanism 75).

In the embodiment, the trimming cutter mechanism 75 as the first cutter is configured to be detachable from the cutting unit 7.

It is preferred that two or more types of trimming cutter mechanisms 75, which respectively include the straight blade portions 753 and/or the arc blade portions 754 with different shapes, are provided so that the trimming cutter mechanism 75 is suitably replaceable according to the usage or the like.

Figure 9A:
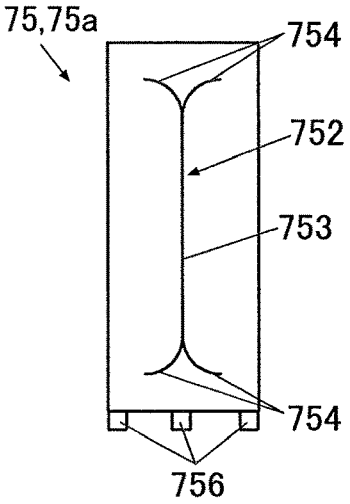
FIG. 9A to FIG. 9C are plan views of examples of trimming cutter mechanisms respectively for printing media with different tape widths.
Figure 9B:
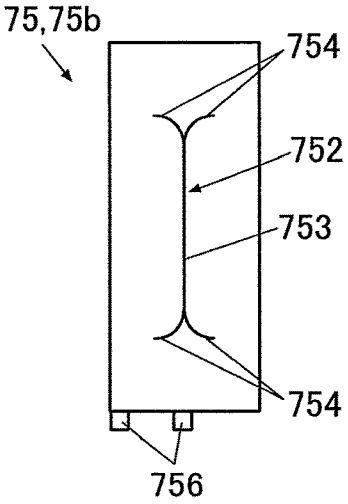
Figure 9C:
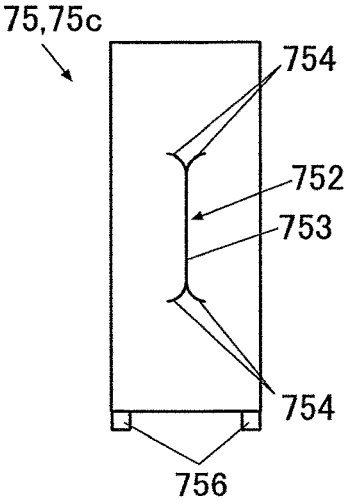

In the embodiment, for example, three types of trimming cutter mechanisms 75 are provided, which are a trimming cutter mechanism 75*a* including a cutting blade 752 with a length corresponding to a 46 mm-wide printing medium M (see FIG. 9A), a trimming cutter mechanism 75*b* including a cutting blade 752 with a length corresponding to a 36 mm-wide printing medium M (see FIG. 9B), and a trimming cutter mechanism 75*c* including a cutting blade 752 with a length corresponding to a 24 mm-wide printing medium M (see FIG. 9C). The trimming cutter mechanisms 75 are replaceable according to the tape width of the tape cassette 5 loaded in the main body 1.

In the embodiment, the base 751 of the trimming cutter mechanism 75 includes an identification protrusion 756 indicating the type of the cutting blade 752 which serves as the cutters of the trimming cutter mechanisms 75. For example, in the embodiment, the position or the number of the identification protrusion(s) 756 varies according to the type of the cutting blade 752.

A cutter type detection sensor 728 that detects the identification protrusion 756 is disposed in the cutting unit 7 at a position corresponding to the identification protrusion 756 of the loaded trimming cutter mechanism 75. The detection result of the cutter type detection sensor 728 is output to the sensor input circuit 713 (see FIG. 11).

The method of detecting the type of the cutting blade 752 is not limited to the above-described example.

Further, the type of trimming cutter mechanism 75 is not limited to the above-described examples. For example, arc blade portions 754 with different angles or shapes of the curvature or the like may be provided instead of cutting blade portions 752 with different overall lengths.

An entrance conveyance roller 722 that conveys the printing medium M to the trimming cutter mechanism 75 and a tape entry detection sensor 726 that detects entry of the printing medium M into the cutting unit 7 are disposed in the case 73 of the cutting unit 7 in the upstream in the conveyance X direction of the printing medium M with respect to the trimming cutter mechanism 75.

The entrance conveyance roller 722 is a driving roller that is connected to a stepping motor 721 (see FIG. 11) controlled by the conveyer motor control circuit 711.

The tape entry detection sensor 726 detects the tip in the conveyance direction of the printing medium M when it is conveyed to the sensor. The detection result is output to the sensor input circuit 713 (see FIG. 11).

Further, an ejection conveyance roller 723 that ejects the printing medium M from the cutting unit 7 and a tape ejection detection sensor 727 that detects ejection of the printing medium M from the case 73 are disposed in the case 73 in the downstream in the conveyance X direction of the printing medium M with respect to the trimming cutter mechanism 75.

The ejection conveyance roller 723 is a driving roller that is connected to a stepping motor 721 (see FIG. 11) controlled by the conveyer motor control circuit 711.

The tape ejection detection sensor 727 detects the tip in the conveyance direction of the printing medium M when it is conveyed and ejected from the case 73. The detection result is output to the sensor input circuit 713 (see FIG. 11).

Control Configuration of Printing Apparatus

Next, the control configuration of the printing apparatus 100 according to the embodiment will be described.

Figure 10:
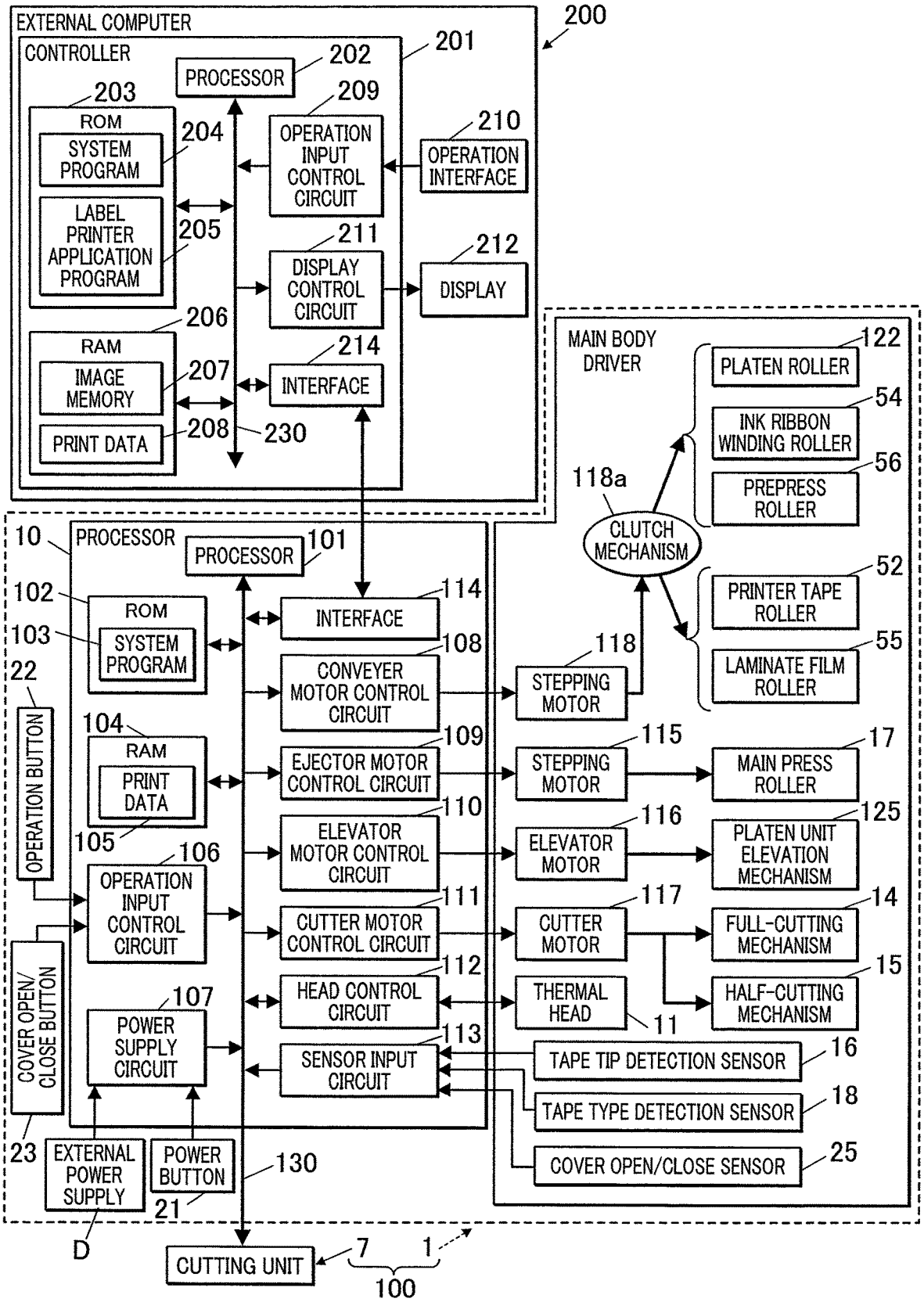
FIG. 10 is a block diagram of the control configuration of the main body of the printing apparatus according to the embodiment.
Figure 11:
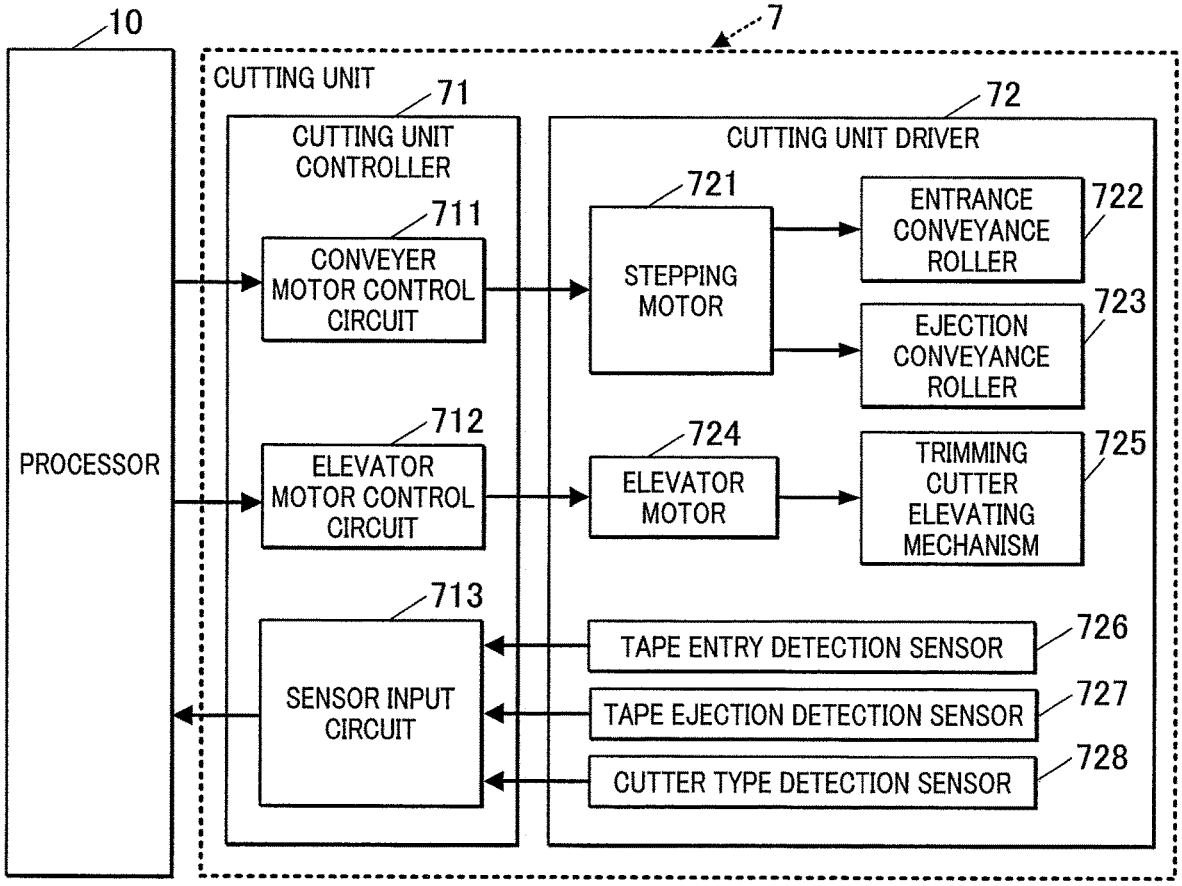
FIG. 11 is a block diagram of the control configuration of the cutting unit of the printing apparatus according to the embodiment.

FIG. 10 is a block diagram of the control configuration of the main body 1, and FIG. 11 is a block diagram of the control configuration of the cutting unit.

As illustrated in FIG. 10, the main body 1 includes the processor 10 that controls the components of the main body driver including the above-described various rollers.

The processor 10 is constituted by a computer that includes a processor 101, a ROM 102, a RAM 104 and the like. The processor 101 is connected to the circuits and the like of the main body 1 through a bus 130. The processor 101 develops a program stored in the ROM 102 to the RAM 104 and executes it to control the operation of the circuits of the main body 1.

In the embodiment, when the cutting unit 7 is attached to the main body 1, the processor 10 of the main body 1 can control the cutting unit 7.

In the embodiment, the processor 101 functions as a printing area obtaining means that obtains information on the printing area of the thermal head 11 as the printer for the printing medium M. That is, when a user inputs a desired text or the like through an operation interface 210 of an external computer 200, the locations of the both ends of the text or the like are sent to the processor 101 of the processor 10 as the printing area information.

The processor 101 also functions as a cutting information obtaining means that obtains cutting information including the length in the longitudinal direction of the printing medium M (trim size Tw, described later) of the area to be trimmed by the trimming cutter mechanism 75 as the first cutter. That is, when the cutter type detection sensor 728 of the cutting unit 7 detects the type of the cutting blade 752 of the trimming cutter mechanism 75, the detection results is sent to the processor 101 of the processor 10 as the cutting information.

The processor 101 also functions as an adjusting means that adjusts the printing area of the thermal head 11 as the printer and the cutting position of the trimming cutter mechanism 75 as the first cutter based on the printing area information obtained by the processor 101 as the printing area obtaining means and the cutting information obtained by the processor 101 as the cutting information obtaining means.

In the ROM 102, a printing program for printing on the printing medium M, a variety of data (e.g. fonts, etc.) required for executing the printing program are stored as well as a system program 103 for integrally controlling the components of the apparatus.

RAM 104 functions as an input data memory that stores information on the content to be printed on the printing medium M. The RAM 104 also functions as a print data memory that stores print pattern data (hereinafter referred to as print data 105) of the content to be printed, which is generated based on the input information on the content to be printed.

The operation input control circuit 106 receives a corresponding signal in response to a user operation through the operation buttons 22 or the cover open/close button 23 of the main body 1.

The operation input control circuit 106 outputs the received operation signal to the processor 101 and the like.

The power supply circuit 107 is connected to an external power supply D through an AC adapter or the like. The power circuit 107 controls power supply to the components of the main body 1 according to the ON/OFF state of the power button 21.

The conveyer motor control circuit 108 controls the operation of the conveyer stepping motor 118 for conveying the printing medium M.

Via a clutch mechanism 118*a*, the stepping motor 118 is connected to the platen roller 122 (the rotation shaft 123 of the platen roller 122), the ink ribbon winding roller 54 (the driving shaft 242 engaged with the ink ribbon winding roller 54), the prepress roller 56 (the rotation shaft 561 of the prepress roller 55), the printer tape roller 52 (the driving shaft 241 engaged with the printer tape roller 52) and the laminate film roller 55 (the driving shaft 243 engaged with the laminate film roller 55). For example, the clutch mechanism 118*a* is constituted by a mechanical one-way clutch.

When the printing medium M is conveyed in the forward direction, i.e. the normal conveyance direction, the clutch mechanism 118*a* converts the rotation of the stepping motor 118 to the forward direction and transmits the rotation to the platen roller 122, ink ribbon winding roller 54 and the prepress roller 56. Then, the platen roller 122, ink ribbon winding roller 54 and the prepress roller 56 are rotary driven by the power of the stepping motor 118 so that the printing medium M is conveyed from the upstream to the downstream in the conveyance X direction.

When the printing medium M is conveyed in the reverse direction of the normal conveyance direction in order to rewind it, the clutch mechanism 118*a* converts the rotation of the stepping motor 118 to the opposite direction and transmits the rotation to the printer tape roller 52 and the laminate film roller 55. Then, the printer tape roller 52 and the laminate film roller 55 are rotary driven by the power of the stepping motor 118 so that the printing medium M and the laminate film F are conveyed from the downstream to the upstream in the conveyance X direction.

The ejector motor control circuit 109 controls the operation of the ejector stepping motor 115 for ejecting the printing medium M.

The stepping motor 115 is connected to the main press roller 17 to drive it. The main press roller 17 is rotary driven by the rotation power of the stepping motor 115 to convey the printed printing medium M in the conveyance X direction so as to eject it from the main body 1.

The elevator motor control circuit 110 controls the operation of the elevator motor 116.

The elevator motor 116 is connected to the platen unit elevating mechanism 125 to drive it.

In the embodiment, when the openable cover 3 is closed and printing on the printing medium M is performed, the elevator motor control circuit 110 drives the platen unit elevating mechanism 125 by means of the power of the elevator motor 116 so as to move the platen unit toward the thermal head 11.

When the openable cover 3 is opened or the printing medium M and the like are rewound before printing on the printing medium M, the elevator motor control circuit 110 drives the platen unit elevating mechanism 125 by means of the power of the elevator motor 116 so as to move the platen unit away from the thermal head 11.

The cutter motor control circuit 111 controls the operation of the cutter motor 117.

The cutter motor 117 is connected to the full-cutting mechanism 14 and the half-cutting mechanism 15 to drive them, which serve as the second cutter 13 in the embodiment.

In the embodiment, a determination as to whether the second cutter 13 performs full-cutting or half-cutting on the printed printing medium M is made according to a command input by the user or the like. When either cutting is performed, the cutter 141 or 151 of the selected full-cutting mechanism 14 or half-cutting mechanism 15 is moved down to the cutting position of the printing medium M. That is, when full-cutting is performed, the cutter 141 is moved down to such a position in the thickness Z direction as to cut all three layers of the laminate film F, the base Ma and the release paper Mb. When half-cutting is performed, the cutter 151 is moved down to such a position in the thickness Z direction as to cut only the two layers of the laminate film F and the base Ma.

The head control circuit 112 controls the operation of the thermal head 11 that serves as the printer in the embodiment. That is, the head control circuit 112 controls the thermal head 11 based on the print data 105 stored in the RAM 104.

The sensor input circuit 113 receives the detection results from the variety or sensors disposed in the main body 1 of the embodiment such as the tape tip detection sensor 16, the tape type detection sensor 18 and the cover open/close sensor 25.

The sensor input circuit 113 outputs the received detection results to the processor 101 and the like.

In the embodiment, the processor 10 of the main body is connected to the controller 201 of the external computer 200 via the interface 114.

The external computer 200 may be constituted by a normal personal computer or any type of portable terminal having a function as a computer.

In the embodiment, the main body 1 of the printing apparatus 100 does not include an operation interface constituted by a keyboard or the like and a display constituted by a liquid crystal display panel or the like. Instead, the main body 1 is configured to be connectable to the external computer 200 that includes the operation interface 210, the display 212 and the like, so that various settings including print contents can be configured on the external computer 200.

The controller 201 of the external computer 200 includes a processor 202, a ROM 203, a RAM 206 and the like. The processor 202 is connected to circuits via a bus 230. The processor 202 develops programs stored in the ROM 203 to the RAM 206 and executes them to control the operation of the circuits.

In the ROM 203, a label printer application program 205 for configuring various setting and the like relating to printing on the printing medium M in the main body 1 of the printing apparatus 100 and a variety of data required for executing the program is stored as well as a system program 204 for integrally controlling the components of the computer.

The RAM 206 functions as an input data memory that stores information on print contents to be printed on the printing medium M. The RAM 206 also functions as a print data memory that stores an image memory 207 for displaying an image on the display 212. The RAM 206 also functions as a print data memory that stores print pattern data (hereinafter referred to as print data 208) of a print content, which is generated based on information on the input print content.

The controller 201 of the external computer 200 is connected to the processor 10 of the main body 1 via an interface 214.

User operations input on the operation interface 210 of the external computer 200 are output to an operation input control circuit 209, and the operation input control circuit 209 outputs them to the processor 202 and the like.

The display control circuit 211 controls the display 212 based on display data and the like stored in the image memory 207 of the RAM 206. The display 212 displays various screens by the control of the display control circuit 211. For example, it may display print contents and the like in a manner that allows the user to understand the progress of a printing process in the main body 1.

As illustrated in FIG. 11, the cutting unit 7 includes a cutting unit controller 71 that is controlled by the processor 10 of the main body 1, and a cutting unit driver 72 that is operated and controlled by the cutting unit controller 71.

The conveyer motor control circuit 711 controls the operation of a conveyer stepping motor 721 for conveying the printing medium M from the main body 1 to the cutting unit 7.

The stepping motor 721 is connected to the entrance conveyance roller 722 and the ejection conveyance roller 723 to drive them. The entrance conveyance roller 722 and the ejection conveyance roller 723 are rotary driven by the power of the stepping motor 721 so as to convey the printed printing medium M in the conveyance X direction and to eject it from the cutting unit 7.

The elevator motor control circuit 712 controls the operation of the elevator motor 724.

The elevator motor 724 is connected to the trimming cutter elevating mechanism 725 to drive it.

In the embodiment, when the printing medium M is conveyed to a predetermined position below the trimming cutter mechanism 75, the trimming cutter elevating mechanism 725 is driven by the power of the elevator motor 724 to press the cutting blade 752 of the trimming cutter mechanism 75 against the printing medium M. The printing medium M is thus half-cut.

After the cutting process, the trimming cutter elevating mechanism 725 is driven by the power of the elevator motor 724 to move the trimming cutter mechanism 75 away from the printing medium M.

The sensor input circuit 713 receives detection results from the variety of sensors disposed in the cutting unit 7 of the embodiment such as the tape entry detection sensor 726, the tape ejection detection sensor 727 and the cutter type detection sensor 728.

The sensor input circuit 713 outputs the received detection results to the processor 101 and the like of the processor 10 of the main body 1.

Function of Printing Apparatus and Printing Method for the Printing Apparatus

Next, the function of the printing apparatus 1 and a printing method for the printing apparatus 1 according to the embodiment will be described referring to FIG. 12A to FIG. 20.

Figure 12A:
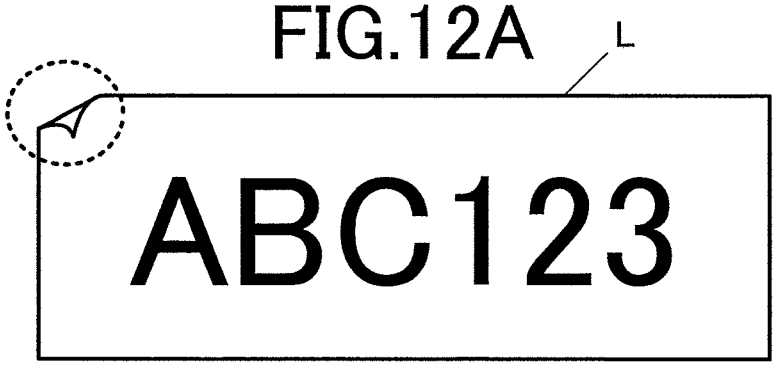
FIG. 12A illustrates an example of a label with four right-angled corners.

The labels L that are printed and cut into individual pieces in the printing apparatus 100 are intended to be pasted on an object with the adhesive sides. If the labels L had a rectangular shape with approximately right-angled corners at the ends in the width direction as illustrated in FIG. 12A, they would be readily peeled off since the corners would be readily scratched.

Figure 12B:
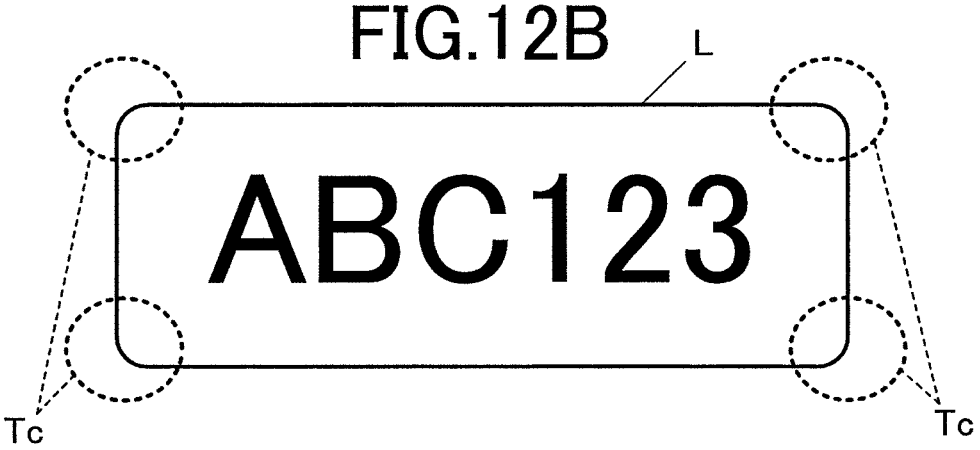
FIG. 12B is an example of a trimmed label with four rounded corners.

To cope with the problem, in the embodiment, the four corners of the labels L are formed into arc cut portions (trimmed portions) Tc as illustrated in FIG. 12B by means of the trimming cutter mechanism 75 of the cutting unit 7.

Figure 12C:
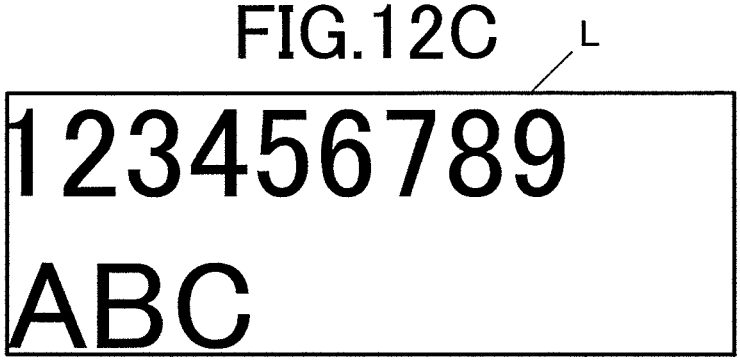
FIG. 12C is an example of a label with four right-angled corners.
Figure 12D:
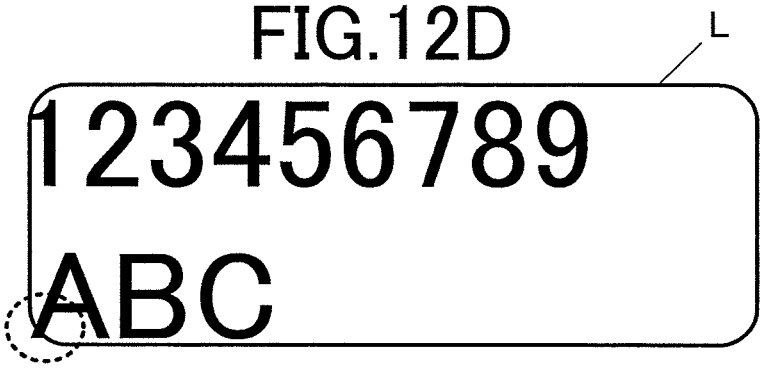
FIG. 12D is an example of a trimmed label with four rounded corners.

However, when the labels L have a rectangular shape with approximately right-angled corners, a printed text or the like almost at the corners is not erroneously lost as a result of the cutting process as illustrated in FIG. 12C. In contrast, when the arc cut portions (trimmed portions) Tc are formed in the four corners of the labels L, a part of a printed text or the like near the corners may be erroneously lost as a result of the cutting process as illustrated in FIG. 12D.

In the printing apparatus 100 of the embodiment, coordination of the printing process by means of the main body 1 with the trimming process by means of the trimming cutter mechanism 75 of the cutting unit 7 enables forming the arc cut portions (trimmed portions) Tc at the four corners of the labels L while preventing a printed text or the like from being partly lost.

Hereinafter, a printing method for the printing apparatus 100 of the embodiment will be specifically described.

Figure 13:
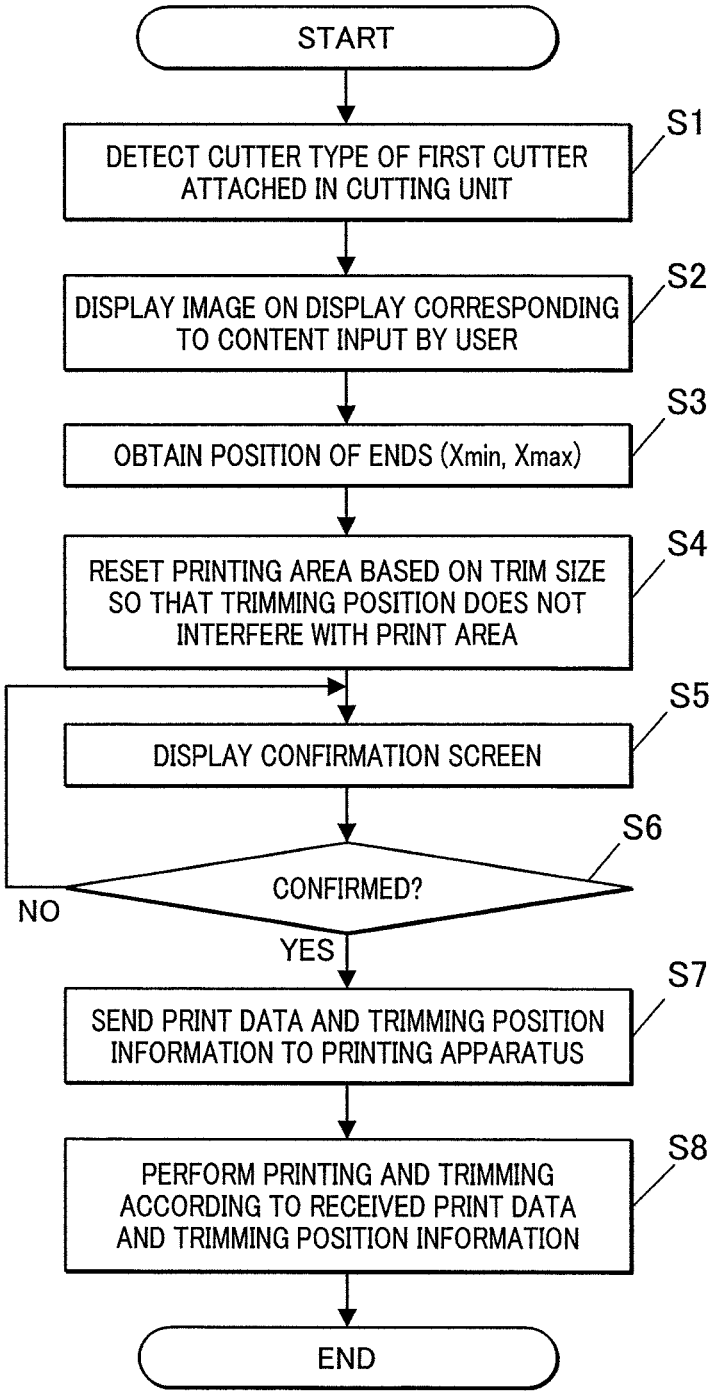
FIG. 13 is a flowchart of an example of a printing method according to the embodiment.

FIG. 13 is a flowchart of an example of the printing method for the printing apparatus 100 of the embodiment.

To make a label L as an individual printed matter by using the printing apparatus 100 of the embodiment, the user firstly loads the tape cassette 5 in the cassette housing 24 of the main body 1 of the printing apparatus 100, attaches the cutting unit 7 to the main body 1 and turns the main body 1 on. Further, the user connects the main body 1 to the external computer 200 in which the label printer application 205 is installed. The connection between the external computer 200 and the main body 1 may be established through either wireless or wired communication.

When the tape cassette 5 is loaded in the cassette housing 24 of the main body 1, the tape type detection sensor 18 detects the type of the loaded tape cassette 5 (e.g. the tape width of the printing medium M or the like).

When the cutting unit 7 is attached to the main body 1, the cutter type detection sensor 728 detects the type of the cutting blade 752 of the trimming cutter mechanism 75 set in the cutting unit 7 as illustrated in FIG. 13 (Step S1). That is, it detects the identification protrusion 756 indicating the cutter type of the cutting blade 752, and the sensor input circuit 713 sends the detection result to the processor 10 of the main body 1. For example, the processor 101 as the cutting information obtaining means of the processor 10 determines based on the detection result that the trimming cutter mechanism 75 as illustrated in FIG. 14 is attached to the cutting unit 7, and then obtains the trim size Tw.

Figure 14:
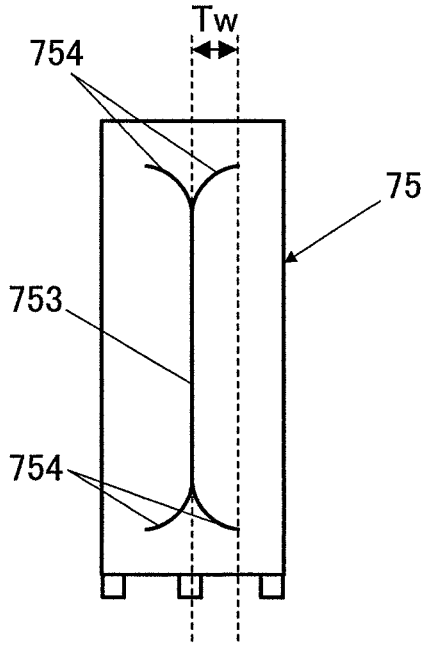
FIG. 14 is a plan view of the trimming cutter mechanism according to the embodiment.

The trim size Tw refers to the distance from the straight blade portion 753 to the tips of the blade edges of the arc blade portions 754 as illustrated in FIG. 14. When the printing medium M is cut into the labels L, the areas with a width corresponding to the trim size Tw are partly cut off in the cutting process since the corners are rounded.

Next, an input screen is displayed on the display 212 of the external computer 200, and the user inputs a desired content to be printed with the printing apparatus 100 through the operation interface 210 or the like.

Figure 15:
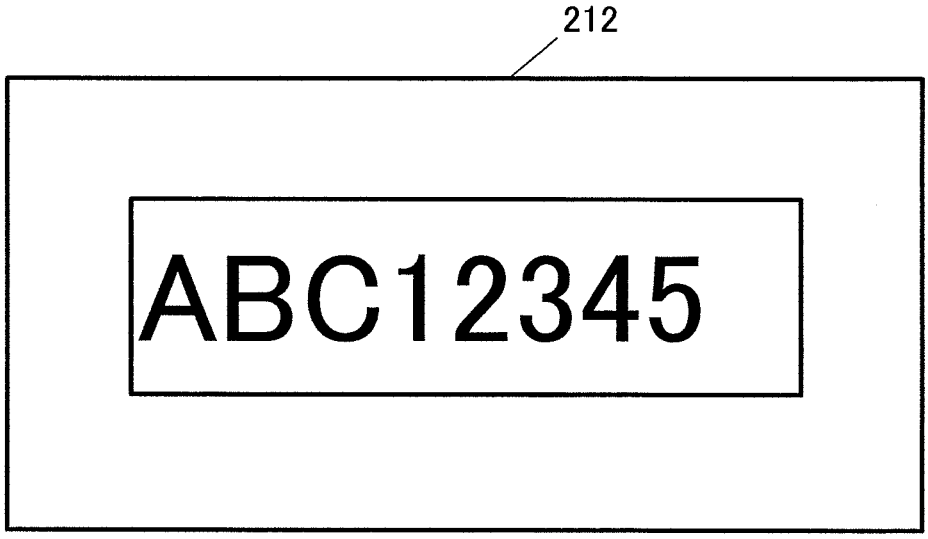
FIG. 15 illustrates an example of a screen displayed on a display of an external computer.

As a result, an image corresponding to the content input by the user is displayed on the display 212 as illustrated in FIG. 15 (Step S2).

Figure 16:
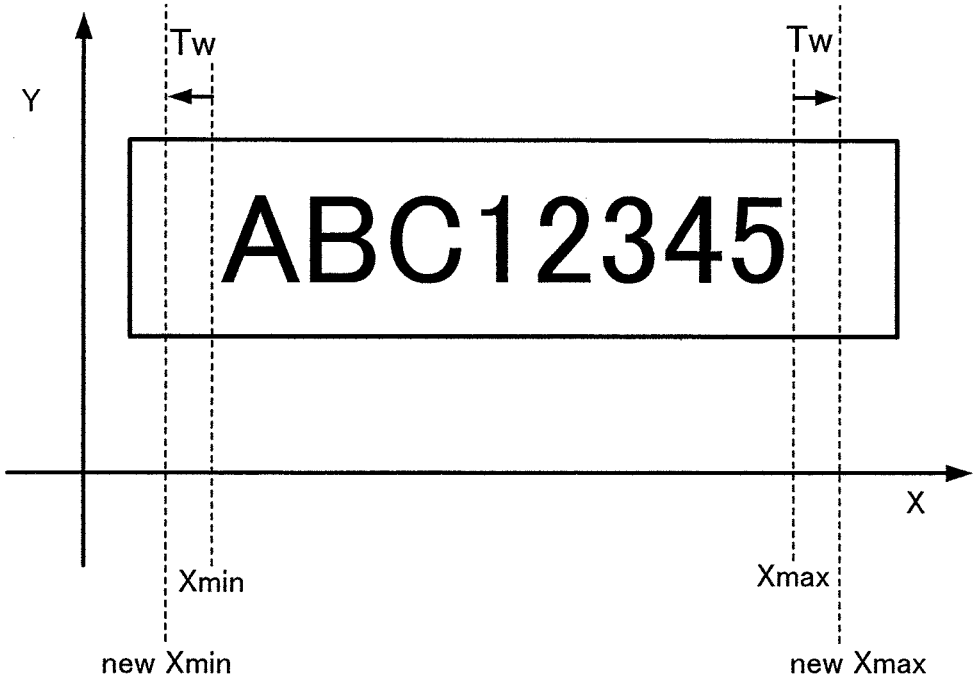
FIG. 16 illustrates resetting of a printing area by a processor.

The external processor 202 of the external computer 200 sends the content input by the user to the processor 10 of the main body 1, and the processor 101 as the printing area obtaining means obtains the printing area (i.e. the location of the both ends in the longitudinal direction of the created image) from the input content to determine the printing area (Xmin, Xmax) as illustrated in FIG. 16 (Step S3).

The processor 101 then functions as the adjusting means that resets the printing area based on the trim size Tw so that the trimming position of the trimming cutter mechanism 75 does not interfere with the print area defined by the printing area (Step S4). That is, the processor 101 shifts the both ends (Xmin, Xmax) of the printing area by the Tw (i.e. shifts the Xmin by (−Tw) and the Xmax by (+Tw)) to create margins. The reset printing area is denoted as "new Xmin" and "new Xmax" in FIG. 16.

Figure 17:
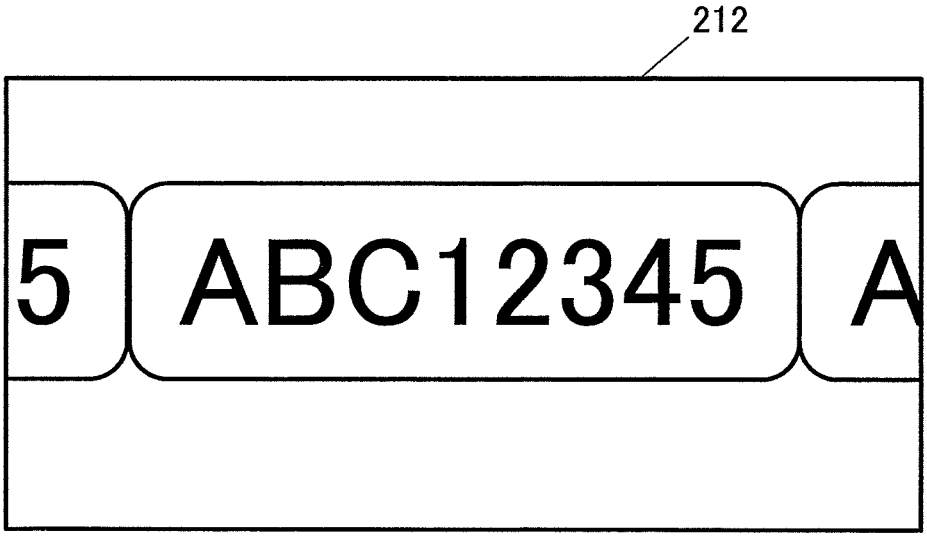
FIG. 17 illustrates an example of the screen displayed on the display of the external computer.

The information on the position of the ends (new Xmin, new Xmax) of the reset print area is sent to the controller 201 of the external computer 200, and the display control circuit 211 of the controller 201 displays a confirmation screen on the display 212, which includes an image of a label L to be printed based on the reset information as illustrated in FIG. 17 (Step S5).

The controller 201 makes a determination as to whether the user confirms the displayed content (e.g. whether the user inputs an OK or a command to start printing through the operation interface 210) (Step S6). When it is determined that the displayed content is not confirmed (Step S6, No), the method returns to Step S5 where the controller 201 asks for confirmation. When it is determined that the displayed content is confirmed (Step S6, Yes), the controller 201 sends the print data and the information on the trimming position to the printing apparatus 100 (Step S7).

When the user is asked for the confirmation of the print content and the trimming position, he/she may be allowed to correct the print content (e.g. to change the text, the font of the text or the like) and to change the trimming position (e.g. to expand the margins to a desired width, to reduce the margins to the minimum with which the text or the like is not lost, or the like). When the user makes a correction or a change, the print data and the information on the trimming position are updated so that the correction or the change is reflected.

The processor 10 controls the thermal head 11 as the printer based on the received information so as to perform the printing process based on the print data. The processor 10 also controls the trimming mechanism 75 of the cutting unit based on the trimming position information so as to perform the cutting (trimming) process (Step S8).

As a result, a label L of the printing medium M2 (individual printed matter) is formed, in which the print content such as a text is printed in the area of the label L without any loss, and the four corners are trimmed in a curved shape such as an arc shape.

For example, when the printing process ends with a full cut of a long printing medium M that includes continuously-made two or more labels L, the processor 10 controls the cutter motor by means of the cutter motor control circuit 111 to drive the full-cutting mechanism 14 as the second cutter 13 of the main body so as to full-cut the printing medium M. In this case, a resultant printed matter is a sheet of the labels L that are formed in a strand on the release paper Mb.

The printing methods applicable in the embodiment are not limited to the above-described method in which the processor 10 automatically sets the printing area.

Figure 18:
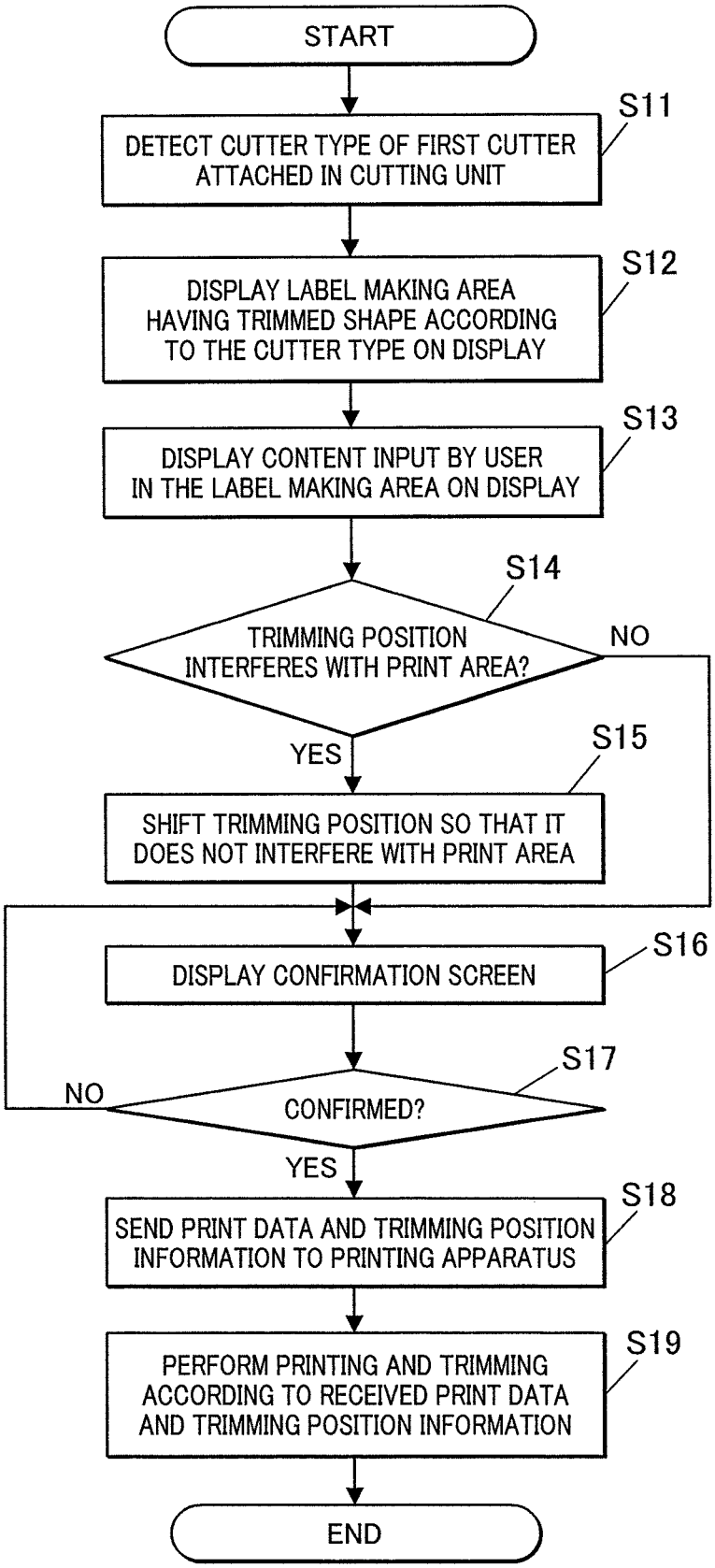
FIG. 18 is a flowchart of an example of the printing method according to the embodiment.
Figure 19:
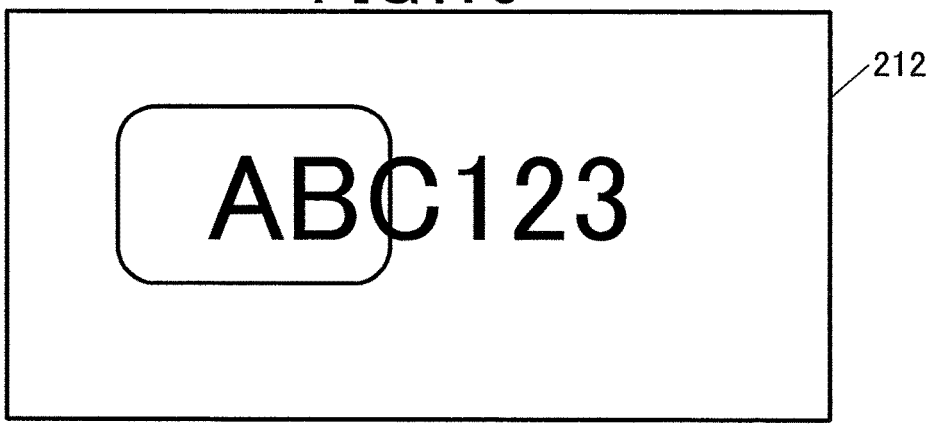
FIG. 19 is an example of a screen displayed on the display of the external computer.

Another example of the printing method is illustrated in FIG. 18. As with the above-described method, the cutter type detection sensor 728 detects the type of the cutting blade 752 of the trimming cutter mechanism 75 set in the cutting unit 7 (Step S11), and the processor 101 as the cutting information obtaining means of the processor 10 obtains the type of the cutting blade 752 from the detection result and thereafter displays a label making area having a shape according to the cutter type on the display 212 of the external computer 200 as illustrated in FIG. 19 (Step S12).

Figure 20:
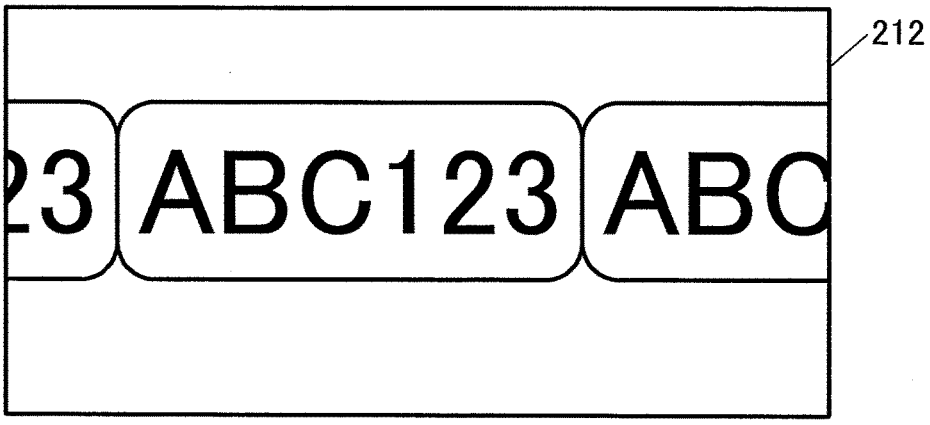
FIG. 20 is an example of a screen displayed on the display of the external computer.

When the user inputs a desired content to be printed with the printing apparatus 100 through the operation interface 210 or the like, an image of the content input by the user laid out in a label making area is displayed on the display 212 as illustrated in FIG. 20 (Step S13).

The processor 202 of the external computer 200 sends the content input by the user to the processor 10 of the main body 1. The processor 101 as the printing area obtaining means obtains the printing area (i.e. the position of the created image to be printed) based on the input content. The processor 101 then makes a determination as to whether the trimming position according to the cutter type interferes with the print area defined by the printing area (Step S14).

When it is determined that the trimming position interferes with the print area (Step S14, Yes), the processor 101 as the adjusting means shifts the trimming position so that it does not interfere with the print area (Step S15).

Step S16 to Step S19 are respectively the same as Step S5 to Step S8 in FIG. 13, and the description thereof is omitted.

Also in the printing method in FIG. 18, the user may be allowed to correct the print content (e.g. to change the text, the font of the text or the like), to change the trimming position (e.g. to expand the margins to a desired width, to reduce the margins to the minimum with which the text or the like is not lost, or the like) when he/she is asked for the confirmation of the print content and the trimming position (i.e. in Step S16). When the user makes a correction or a change, the print data and the information on the trimming position are updated so that the correction or the change is reflected.

Also in the printing method in FIG. 18, a label L of the printing medium M2 (individual printed matter) is formed, in which the print content such as a text desired by the user is printed in the area of the label L without any loss, and the four corners are trimmed.

As described above, the printing apparatus 1 of the embodiment includes the trimming cutter mechanism 75 as the first cutter that includes the straight blade portion 753 extending in the width direction of the printing medium M and the arc blade portions 754 integrally formed at the both ends of the straight blade portion 753 for trimming corners and that cuts a printed part of the printing medium M into individual printed matters.

As described above, the straight blade portion 753 and the arc blade portions 754 are integrally formed in the trimming cutter mechanism 75 as the first cutter. This enables making a label L, i.e. the printing medium M2 (individual printed matter) with trimmed corners, by a single cutting motion and thus rapidly and continuously making less-peelable labels L.

Further, compared to separately cutting the straight portion and the corners, the labels L have a beautiful cutting edge since misalignment of the cutting position does not occur.

The printing medium M of the embodiment includes the base Ma with the adhesive side and the peelable release paper Mb covering the adhesive side. This enables the user to readily paste the label L at a desired location.

The label L, which is an individual printed matter, is made by the process that involves printing on the other side of the base Ma from the adhesive side by means of the thermal head 11 as the printer and cutting only the base Ma of the printing medium M with the trimming cutter mechanism 75 as the first cutter. With this process, it is possible to readily make labels L that are arrayed in a single strand on the release paper Mb and can be peeled from the release paper one by one.

In the embodiment, the trimming cutter mechanism 75 as the first cutter is configured to be detachable, and two or more types of exchangeable trimming cutter mechanisms 75 having the straight blade portions and/or the arc blade portions with different shapes are provided. This can impart compatibility with various printing media M with different tape widths to the printing apparatus 100.

The main body 1 includes the second cutter 13 that is disposed in the downstream of the conveyance path with respect to the thermal head 11 as the printer and that cuts a printed part of the printing medium M into individual printed matters. Since the main body 1 also includes the cutter, it is possible to rapidly and readily cut the printing medium in a desired manner according to the usage or the like.

The trimming cutter mechanism 75 as the first cutter is disposed in the cutting unit 7 that is detachable from the main body 1. When the user does not need trimming of the corners or wants only full-cutting, he/she only has to detach the cutting unit 7 without exchanging the cutter. The printing apparatus can thus be rapidly and readily adapted to various usages.

In the embodiment, the processor 101 of the processor 10 functions as: the printing area obtaining means that obtains information on the printing area of the thermal head 11 as the printer on the printing medium M; the cutting information obtaining means that obtains cutting information including the cutting shape of the trimming cutter mechanism 75 as the first cutter; and the adjusting means that adjusts the printing area of the thermal head 11 and/or the cutting position of the trimming cutter mechanism 75 based on the printing area information and the cutting information.

Even when trimming the corners of the labels L, it is possible to prevent the print content desired by the user from being interfered with the trimmed part and thereby partially lost. Therefore, it is possible to make beautiful labels L that are less peelable since the four corners are trimmed into an arc or round shape. Furthermore, the print content is beautifully arranged in the areas of the labels L.

While an embodiment of the present invention is described, the present invention is not limited to the above-described embodiment, and a variety of changes can be made without departing from the features of the present invention.

For example, the embodiment is an example in which the laminate film F is pasted on the printing side after printing, and the resultant labels L are the printing medium M2 (individual printed matters) that has the printing side coated with the laminate film F. However, the labels L as the printing medium M2 (individual printed matters) made with the printing apparatus 100 are not limited thereto, and the laminate film F may not be pasted thereon.

Figure 21:
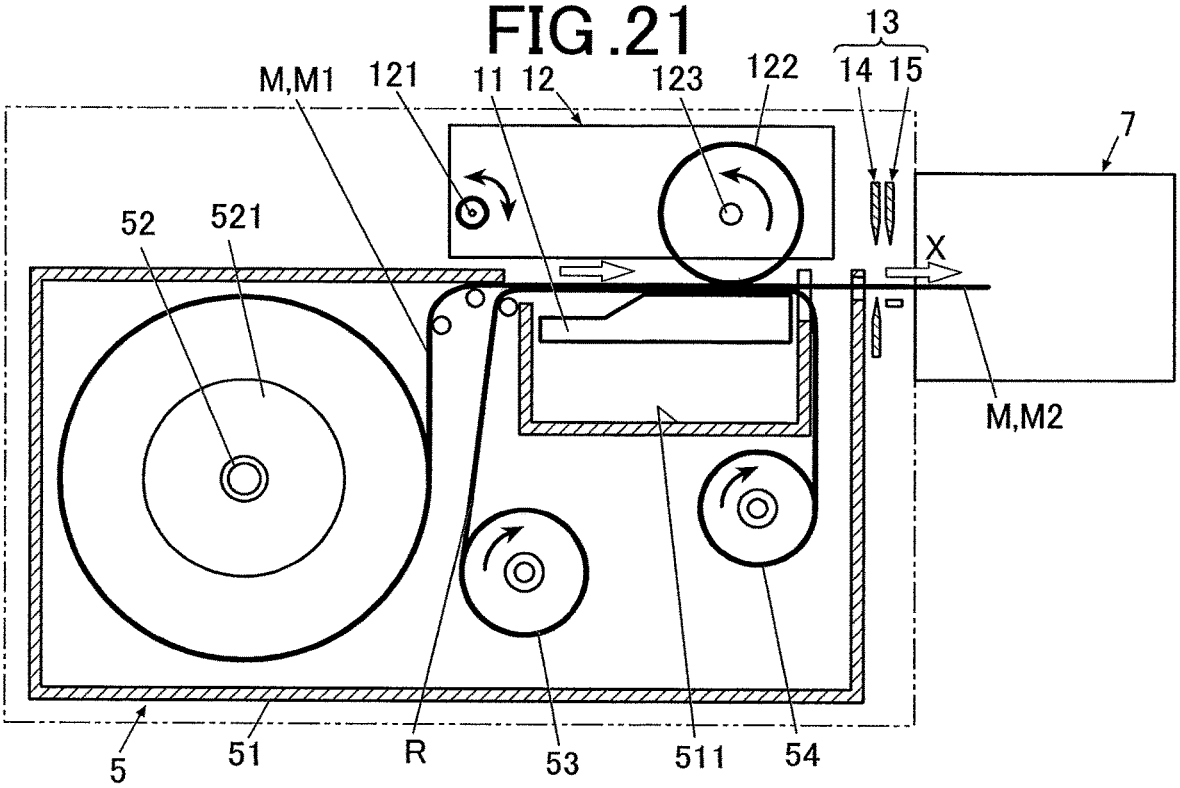
FIG. 21 is a schematic view of a variation of the printing apparatus according to the embodiment.

In this case, it not necessary to provide the laminate film roller to the tape cassette 5 to be loaded in the printing apparatus as illustrated in FIG. 21. Further, it is not necessary to provide the prepress roller 56 and the main press roller 17 for fixing the laminate film F on the printing side of the printing medium M by pressure. This can simplify the configuration of the printing apparatus 100.

While a few embodiments of the present invention are described, the scope of the present invention is not limited to the above-described embodiments but encompasses the scope of the invention recited in the claims and the equivalents thereof.

What is claimed is:

1. A printing apparatus, comprising:

a print head which performs printing on a printing medium;

a first cutter which cuts the printing medium on which the print head has performed the printing; and a processor;

wherein the first cutter trims away at least one of corners of the printing medium;

wherein the processor obtains printing area information on a printing area of the print head and cutting information on an area to be trimmed by the first cutter;

wherein the processor controls the print head and the first cutter based on the cutting information so that a printing area of the printing medium is not cut by the first cutter; and wherein the processor adjusts at least one of the printing area of the print head and a trimming position of the first cutter based on the printing area information and the cutting information so that the printing area of the printing medium is not cut by the first cutter.

2. The printing apparatus according to claim 1, wherein the first cutter comprises a cutting blade for cutting the printing medium so as to trim the printing medium, and wherein the cutting blade is detachable from the first cutter.

3. The printing apparatus according to claim 1, wherein the cutting blade comprises a first blade portion for cutting a part of a width of the printing medium in a straight shape and second blade portions which are integrally formed at both ends in an extending direction of the first blade portion for trimming the corners of the printing medium at an end in a width direction of the printing medium.

4. The printing apparatus according to claim 1, wherein the printing medium comprises a base with an adhesive side and a peelable release paper covering the adhesive side, and the printing is performed on a printing side of the base opposite from the adhesive side, and wherein the first cutter cuts the printing medium except for the release paper.

5. The printing apparatus according to claim 1, wherein the first cutter is disposed in a cutting unit which is configured to be detachable from a main body comprising the print head and a conveyer.

6. The printing apparatus according to claim 5, wherein the main body further comprises a second cutter which cuts the printing medium on which the print head has performed the printing.

7. A printing method for a printing apparatus, wherein the printing apparatus comprises:

a print head which performs printing on a printing medium; and a first cutter which cuts the printing medium on which the print head has performed the printing, so as to trim away at least one of corners of the printing medium, and wherein the method comprises:

obtaining printing area information on a printing area of the print head and cutting information on an area to be trimmed by the first cutter;

controlling the print head and the first cutter based on the cutting information so that a printing area of the printing medium is not cut by the first cutter; and adjusting at least one of the printing area of the print head and a trimming position of the first cutter based on the printing area information and the cutting information so that the printing area of the printing medium is not cut by the first cutter.

8. A non-transitory computer readable medium which stores a program for controlling a computer in a printing apparatus that comprises a print head which performs printing on a printing medium and a first cutter which cuts the printing medium on which the print head has performed the printing, said program controlling the computer to perform operations comprising:

obtaining printing area information on a printing area of the print head and cutting information on an area to be trimmed by the first cutter;

controlling the print head and the first cutter based on the cutting information so that a printing area of the printing medium is not cut by the first cutter; and adjusting at least one of the printing area of the print head and a trimming position of the first cutter based on the printing area information and the cutting information so that the printing area of the printing medium is not cut by the first cutter.

* * * * *